US009344822B2

(12) United States Patent
Deng

(10) Patent No.: US 9,344,822 B2
(45) Date of Patent: May 17, 2016

(54) ESTIMATING NONLINEAR DISTORTION AND PARAMETER TUNING FOR BOOSTING SOUND

(75) Inventor: Huiqun Deng, Beijing (CN)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 318 days.

(21) Appl. No.: 14/131,679

(22) PCT Filed: Jul. 3, 2012

(86) PCT No.: PCT/US2012/045466
§ 371 (c)(1),
(2), (4) Date: Jan. 8, 2014

(87) PCT Pub. No.: WO2013/009548
PCT Pub. Date: Jan. 17, 2013

(65) Prior Publication Data

US 2014/0140522 A1 May 22, 2014

Related U.S. Application Data

(60) Provisional application No. 61/514,592, filed on Aug. 3, 2011.

(30) Foreign Application Priority Data

Jul. 8, 2011 (CN) ..... 2011 1 0203519

(51) Int. Cl.
*H04R 29/00* (2006.01)
*H04R 3/08* (2006.01)

(52) U.S. Cl.
CPC ..... *H04R 29/001* (2013.01); *H04R 3/08* (2013.01); *H04R 29/003* (2013.01)

(58) Field of Classification Search
CPC ..... H04R 29/001; H04R 29/003; H04R 3/08
USPC ..... 381/59, 71.1, 71.11, 94.1, 94.9, 96, 98, 381/312; 700/94
See application file for complete search history.

(56) References Cited

U.S. PATENT DOCUMENTS 5,420,516 A 5/1995 Cabot
5,600,718 A 2/1997 Dent
(Continued)

FOREIGN PATENT DOCUMENTS

EP 0602279 6/1994
EP 1752969 2/2007
(Continued)

OTHER PUBLICATIONS

Ward, B. et al, "Examining Nonlinear Distortion with Multitone Stimuli," Proceedings of the AES 11th International Conference, AES Test and Measurement Conference, May 1, 1992.
(Continued)

*Primary Examiner* — Vivian Chin
*Assistant Examiner* — Friedrich W Fahnert

(57) ABSTRACT

Embodiments for estimating nonlinear distortion and for tuning parameter(s) for boosting sounds are described. A test signal including at least two simultaneous audible tones is generated. One tone is a fundamental tone and others are harmonics of the fundamental tone. The ratio of the number of nonlinear distortion products not coincident with the frequencies of the tones to the number of all the products is, as an example, greater than 0.80. A spectral analysis is performed on the response of a loudspeaker to the test signal. A nonlinear distortion value is estimated by regarding the energy at harmonic frequencies of the fundamental tone signal but not at the frequencies of the tone signals as contribution from the nonlinear distortion. A subjectively correlated measure of nonlinear distortion is obtained for tuning a parameter for boosting low frequency outputs of one or more loudspeakers.

19 Claims, 8 Drawing Sheets

(56) References Cited

U.S. PATENT DOCUMENTS

| | | | | |
|---|---|---|---|---|
| 5,748,001 | A | 5/1998 | Cabot | |
| 6,005,952 | A | 12/1999 | Klippel | |
| 7,082,205 | B1 | 7/2006 | Westermann | |
| 7,092,536 | B1 | 8/2006 | Hutt | |
| 7,359,519 | B2 | 4/2008 | Lee | |
| RE40,322 | E | 5/2008 | Williams | |
| 7,593,535 | B2 | 9/2009 | Shmunk | |
| 7,609,759 | B2 | 10/2009 | Raz | |
| 7,720,236 | B2 | 5/2010 | Oxford | |
| 7,760,887 | B2 | 7/2010 | Oxford | |
| 7,826,624 | B2 | 11/2010 | Oxford | |
| 2008/0037804 | A1 * | 2/2008 | Shmunk | H04R 3/04 381/96 |
| 2008/0101619 | A1 | 5/2008 | Shmunk | |
| 2009/0323983 | A1 | 12/2009 | De Muynke | |
| 2010/0166216 | A1 | 7/2010 | Chambers | |
| 2010/0228368 | A1 | 9/2010 | Oh | |

FOREIGN PATENT DOCUMENTS

| | | |
|---|---|---|
| EP | 1799013 | 6/2007 |
| EP | 1843635 | 10/2007 |
| EP | 1843636 | 10/2007 |
| EP | 1962419 | 8/2008 |
| GB | 2426404 | 11/2006 |
| WO | 99/26454 | 5/1999 |

OTHER PUBLICATIONS

Rumsey, F., "DSP in Loudspeakers," JAES, vol. 56, Issue 1/2, pp. 65-72, Jan. 2008.
Bright, Andrew, "Simplified Loudspeaker Distortion Compensation by DSP," AES Conference: 23rd International Conference: Signal Processing in Audio Recording and Reproduction, May 2003.
Temme, S. et al, "A New Method for Measuring Distortion Using Multitone Stimulus and Non-coherence," Audio Engineering Society, Oct. 5-8, 2006.
Czerwinski, E. et al, "Multitone Testing of Sound System Components-Some Results and Conclusions, Part 1: History and Theory," Journal of Audio Engineering Society, vol. 49, Issue 11, pp. 1011-1048, Nov. 2001.
Bard, D. et al, "Compensation of Nonlinearities of Horn Loudspeakers," AES Convention 119, Oct. 2005.
Klippel, W., "Compensation for Nonlinear Distortion of Horn Loudspeakers by Digital Signal Processing," Journal of the Audio Engineering Society, vol. 44, Issue 11, pp. 964-972, Nov. 1996.
Hamada, J. et al, "Development of a Software Tool for Eliminating Nonlinear Distortion," Acoustical Science and Technology, vol. 24, Issue 4, pp. 186-191, Jul. 2003.
Frank, W. et al, "Loudspeaker Nonlinearities-Analysis and Compensation," Conference Record of the Twenty-Sixth Asilomar Conference on Signals, Systems and Computers, Oct. 26-28, 1992.
Kitagawa, S. et al, "Dynamic Distortion Measurement for Linearization of Loudspeaker Systems," International Symposium on Intelligent Signal Processing and Communication Systems, ISPACS 2008. International Symposium, pp. 1-4, Feb. 8-11, 2009.
Soria-Rodriguez, M. et al, "Modeling and Real-Time Auralization of Electrodynamic Loudspeaker Non-Linearities," IEEE International Conference on Acoustics, Speech, and Signal Processing, May 2004.
IEC 60268-5, "Sound System Equipment—Part 5: Loudspeakers," Sep. 2007.
SMPTE, RP120, "Measurement of Intermodulation Distortion in Motion-Picture Audio Systems," vol. 92, pp. 621-622, May 1983.
Belcher, R. et al, "A Three-Tone Test Signal for Digital Audio Systems," 84th Convention of Audio Engineering Society, May 1988.
Cordell, R. et al, "A Full In-Band Multitone Test for Transient Intermodulation Distortion," JAES, vol. 29, Issue 9, pp. 578-586, Sep. 1981.
Cabot, R., "Comparison of Nonlinear Distortion Measurement Methods," AES 11th International Conference, pp. 53-65, May 1992.
Temme, S. et al, "A New Method for Measuring Distortion Using a Multitone Stimulus and Non-Coherence," AES 121th Convention, Oct. 2006.
Gil-Cacho, P. et al, "Study and Characterization of Odd and Even Nonlinearities in Electrodynamic Loudspeakers," AES 127th Convention , Oct. 2009.
Vanhoenacker, K. et al, "Design of Multisine Excitiations to Characterize the Nonlinear Distortions During FRF-Measurements," IEEE Transactions Instrumentation and Measurement, vol. 50, Issue 5, pp. 1097-1102, Oct. 2001.
Farina, A., "Silence Sweep: A Novel Method for Measuring Electro-Acoustical Devices," AES 126th Convention, May 2009.
Siczek, R. et al, "Measurement of the Nonlinear Distortions in Loudspeakers with a Broadband Noise," AES 128th Convention, May 2010.
Beerends J. et al,"A Perceptual Audio Quality Measure Based on a Psycoacoustic Sound Representation," JAES, vol. 40, Issue 12, pp. 963-977, Dec. 1992.
ITU-R BS.1387, "Method for Objective Measurements of Perceived Audio Quality," Nov. 2001.
Czerwinski, E. et al, "Multitone Testing of Sound System Components-Some Results and Conslusions Part 2: Modeling and Application," JAES, vol. 49, Issue 12, Dec. 1, 2001.
Voishvillo, A. "Assessment of Nonlinearity in Transducers and Sound Systems—From THD to Perceptual Models," AES, Oct. 2006.
Bright, A. "Discrete-Time Loudspeaker Modelling," AES Convention, Mar. 2003.
Bellini, A. et al, "APLODSP, Design of Customizable Audio Processors for Loudspeaker System Compensation by DSP," AES Convention, Sep. 2000.
Tsujikawa, M. et al, "Identification and Elimination of Second-Order Nonlinear Distortion of Loudspeaker Systems Using Digital Volterra Filter," European Signal Processing Conference, May 28-31, 2000.
Yong-Sheng, D., "A Tone-Burst Method for Measuring Loudspeaker Harmonic Distortion at High Power Levels," JAES, Mar. 1, 1985.
Frank, W., "An Efficient Approximation to the Quadratic Volterra Filter and its Application in Real-Time Loudspeaker Linearization," Signal Processing, vol. 45, Issue 1, pp. 97-113, Jul. 1995.
De Vries, R. et al, "Digital Compensation of Nonlinear Distortion in Loudspeakers," IEEE International Conference on Acoustics, Speech and Signal Processing, Apr. 27-30, 1993.
Cho, Y. et al, "Two-Tone VS. Random Process Inputs for Nonlinear Distortion Estimation," IEEE International Conference on Acoustics, Speech and Signal Processing, Mar. 23-26, 1992.
Ishikawa, T. et al, "A Consideration of the Elimination of Nonlinear Distortion of a Loudspeaker System by Using a Digital Volterra Filter," Electronics and Communications in Japan, Part III: Fundamental Electronic Science, Jan. 1999.
Katayama, T. et al, "Reduction of Second Order Non-Linear Distortion of a Horn Loudspeaker by a Volterra Filter-Real-Time Implementation," AES Convention, Sep. 1997.
Schurer, H. et al, "Modeling and Compensation of Nonlinear Distortion in Horn Loudspeakers," JAES, vol. 43, Issue 7/8, pp. 592-598, Jul. 1995.
Klippel, W., "Measurement and Application of Equivalent Input Distortion," JAES, vol. 52, Issue 9, pp. 931-947, Sep. 15, 2004.
Czerwinski, E. et al, "Multitone Testing of Sound System Components-Some Results and Conclusions, Part 1: History and Theory," Journal of Audio Engineering Society, vol. 49, Issue 11, pp. 1011-1048, Jan. 1, 2001.
Voishvillo, A. et al, "Graphing, Interpretation, and Comparison of Results of Loudspeaker Nonlinear Distortion Measurements," JAES, vol. 52, Issue 4, pp. 332-357, Apr. 4, 2004.

* cited by examiner

ESTIMATING NONLINEAR DISTORTION AND PARAMETER TUNING FOR BOOSTING SOUND

CROSS-REFERENCE TO RELATED APPLICATIONS

This application claims priority to U.S. Patent Provisional Application No. 61/514,592, filed 3 Aug. 2011, and Chinese Patent Application No. 201110203519.6, filed 8 Jul. 2011, hereby incorporated by reference in entirety.

TECHNICAL FIELD

The present invention relates generally to nonlinear distortion measurement and parameter adjustment for loudspeaker systems. More specifically, embodiments of the present invention relate to a method of and a system for estimating nonlinear distortion of a loudspeaker, and a method of and a system for tuning a parameter for boosting sounds of the loudspeaker.

BACKGROUND

In general, output signals of a loudspeaker may have a nonlinear relationship with input signals to the loudspeaker. In other words, there is nonlinear distortion in the output of the loudspeaker. Various methods have been proposed to estimate the nonlinear distortion in the output of the loudspeaker. According to one kind of the methods, a multi-tone test signal is used to estimate the nonlinear distortion. The multi-tone test signal is the sum of several sinusoidal waves whose frequencies are typically distributed logarithmically across the audio frequency range, which is considered to be similar to the spectrum of musical signals. An example of such methods can be found in Richard C. Cabot et al., "METHOD AND APPARATUS FOR FAST RESPONSE AND DISTORTION MEASUREMENT," U.S. Pat. No. 5,748,001.

SUMMARY

According to an embodiment of the present invention, a method of estimating nonlinear distortion of a loudspeaker is provided. A test signal including at least two simultaneous audible tone signals is generated. One of the tone signals is a fundamental tone signal, and each of the rest of the tone signals is a harmonic of the fundamental tone signal. Among harmonic distortion products and intermodulation distortion products of the tone signals within a specified audible frequency range and below a predetermined order of nonlinearity, a ratio of the number of the products not at the frequencies of the tone signals to the number of all the products, or separation ratio, is greater than a predetermined value (e.g., 0.8). A spectral analysis is performed on the response of a loudspeaker to the test signal. A nonlinear distortion value is estimated, or otherwise determined, by regarding the energy at harmonic frequencies of the fundamental tone signal but not at the frequencies of the tone signals as contribution from the nonlinear distortion.

According to another embodiment of the present invention, a system for estimating nonlinear distortion of a loudspeaker is provided. The system includes a signal generator, an analyzer and an estimator. The signal generator generates a test signal including at least two simultaneous audible tone signals. One of the tone signals is a fundamental tone signal and each of the rest of the tone signals is a harmonic of the fundamental tone signal. Among harmonic distortion products and intermodulation distortion products of the tone signals within a specified audible frequency range and below a predetermined order of nonlinearity, a ratio of the number of the products not at the frequencies of the tone signals to the number of all the products, or separation ratio, is greater than a predetermined value (e.g., 0.8). The analyzer performs a spectral analysis on the response of the loudspeaker to the test signal. The estimator estimates a nonlinear distortion value by regarding the energy at harmonic frequencies of the fundamental tone signal but not at the frequencies of the tone signals as contribution from the nonlinear distortion.

According to an embodiment of the present invention, a method of tuning a parameter for boosting sounds below the lower cutoff frequency of an electro-dynamic loudspeaker is provided. The parameter is set to a parameter value. A test signal including at least two simultaneous audible tone signals is generated. One of the tone signals is a fundamental tone signal and each of the rest of the tone signals is a harmonic of the fundamental tone signal. Among harmonic distortion products and intermodulation distortion products of the tone signals within a specified audible frequency range and below a predetermined order, a ratio of the number of the products not at the frequencies of the tone signals to the number of all the products, or separation ratio, is greater than a predetermined value (e.g., 0.8). The test signal is processed in case of enabling the boosting. Spectral analyses are performed on the responses of the loudspeaker to the test signal in case of enabling the boosting and in case of disabling the boosting respectively. Nonlinear distortion values are estimated by regarding the energy at harmonic frequencies of the fundamental tone signal but not at the frequencies of the tone signals as contribution from the nonlinear distortion in the two cases respectively. A difference is calculated by subtracting the nonlinear distortion value estimated in case of disabling the boosting from the nonlinear distortion value estimated in case of enabling the boosting based on the setting of the parameter value. The parameter value is accepted if the difference is lower than a threshold.

According to another embodiment of the present invention, a system for tuning a parameter for boosting sounds below the lower cutoff frequency of an electro-dynamic loudspeaker is provided. The system includes a controller, a signal generator, a bass enhancer, an analyzer, a calculator and a judger. The controller sets the parameter to a parameter value. The signal generator generates a test signal including at least two simultaneous audible tone signals. One of the tone signals is a fundamental tone signal and each of the rest of the tone signals is a harmonic of the fundamental tone signal. Among harmonic distortion products and intermodulation distortion products of the tone signals within a specified audible frequency range and below a predetermined order, a ratio of the number of the products not at the frequencies of the tone signals to the number of all the products, or separation ratio, is greater than a predetermined value (e.g., 0.8). The bass enhancer processes the test signal in case of enabling the boosting and does not process the test signal in case of disabling the boosting. The analyzer performs spectral analyses on the responses of the loudspeaker to the test signal in the two cases respectively. The estimator estimates nonlinear distortion values by regarding the energy at harmonic frequencies of the fundamental tone signal but not at the frequencies of the tone signals as contribution from the nonlinear distortion in the two cases respectively. The calculator calculates a difference by subtracting the nonlinear distortion value estimated in case of disabling the boosting from the nonlinear distortion value estimated in case of enabling the boosting based on the setting of the parameter value. The judger accepts the parameter value if the difference is lower than a threshold.

According to another embodiment of the present invention, a computer-readable medium having computer program instructions recorded thereon is provided. The computer program instructions enable a processor to perform a method of estimating nonlinear distortion of a loudspeaker. According to the method, a test signal including at least two simultaneous audible tone signals is generated. One of the tone signals is a fundamental tone signal and each of the rest of the tone signals is a harmonic of the fundamental tone signal. Among harmonic distortion products and intermodulation distortion products of the tone signals within a specified audible frequency range and below a predetermined order, a ratio of the number of the products not at the frequencies of the tone signals to the number of all the products, or separation ratio, is greater than a predetermined value (e.g., 0.8). A spectral analysis is performed on the response of the loudspeaker to the test signal. A nonlinear distortion value is estimated by regarding the energy at harmonic frequencies of the fundamental tone signal but not at the frequencies of the tone signals as contribution from the nonlinear distortion.

According to another embodiment of the present invention, a computer-readable medium having computer program instructions recorded thereon is provided. The computer program instructions enable a processor to perform a method of tuning a parameter for boosting sounds below the lower cutoff frequency of an electro-dynamic loudspeaker. According to the method, the parameter is set to a parameter value. A test signal including at least two simultaneous audible tone signals is generated. One of the tone signals is a fundamental tone signal and each of the rest of the tone signals is a harmonic of the fundamental tone signal. Among harmonic distortion products and intermodulation distortion products of the tone signals within a specified audible frequency range and below a predetermined order, a ratio of the number of the products not at the frequencies of the tone signals to the number of all the products, or separation ratio, is greater than a predetermined value (e.g., 0.8). The test signal is processed in case of enabling the boosting. Spectral analyses are performed on the responses of the loudspeaker to the test signal in case of enabling the boosting and in case of disabling the boosting respectively. Nonlinear distortion values are estimated by regarding the energy at harmonic frequencies of the fundamental tone signal but not at the frequencies of the tone signals as contribution from the nonlinear distortion in the two cases respectively. A difference is calculated by subtracting the nonlinear distortion value estimated in case of disabling the boosting from the nonlinear distortion value estimated in case of enabling the boosting based on the setting of the parameter value. The parameter value is accepted if the difference is lower than a threshold.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF DRAWINGS

The present invention is illustrated by way of example, and not by way of limitation, in the figures of the accompanying drawings and in which like reference numerals refer to similar elements and in which.

DETAILED DESCRIPTION

Figure 1:
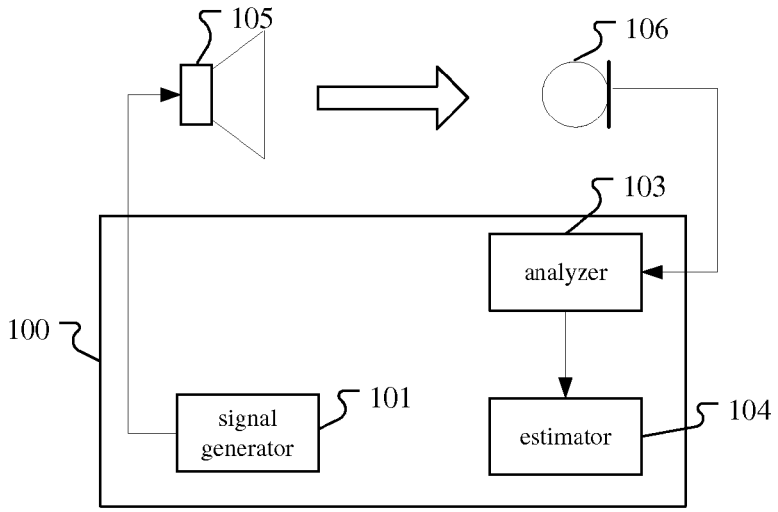
FIG. 1 is a block diagram illustrating an example system for estimating nonlinear distortion of a loudspeaker according to an embodiment of the present invention.

The embodiments of the present invention are below described by referring to the drawings. It is to be noted that, for purpose of clarity, representations and descriptions about those components and processes known by those skilled in the art but not necessary to understand the present invention are omitted in the drawings and the description.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, microcode, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof.

A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wired line, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

Estimating Nonlinear Distortion

The output of a loudspeaker in response to an audio signal may include nonlinear distortion. In general, from a view point of spectrum of the output, the nonlinear distortion may include harmonic distortion and intermodulation distortion of tone signals in the audio signal, if the audio signal includes tone signals $T_1, T_2, \ldots, T_n$ at frequencies $F_1, F_2, \ldots, F_n$ respectively. The harmonic distortion of tone signal $T_i$ may contribute to the output at $H(T_i)$, where $H(T_i)$ represents harmonic frequencies of tone signal $T_i$, i.e., $2F_i$, $3F_i$, $4F_i$, . . . . In the hereafter, the nonlinear contributions at harmonic frequencies of a tone signal to the output are also called as the harmonic distortion products of the tone signal, and the order of the harmonic of the tone signal is also called as the order of the corresponding harmonic distortion product. The intermodulation distortion may contribute to the output at frequencies of linear combinations of frequencies of the tone signals $K_{i1}\times F_{i1}+K_{i2}\times F_{i2}+\ldots+K_{im}\times F_{im}$, where $K_{i1}$, $K_{i2}, \ldots, K_{im}$ are integers. In the hereafter, the nonlinear contributions at frequencies of linear combinations of frequencies of tone signals are also called as the intermodulation distortion products of the tone signals. The sum of $abs(K_{i1})$, $abs(K_{i2}), \ldots, abs(K_{im})$ is also called as the order of the intermodulation distortion product at frequency $K_{i1}\times F_{i1}+K_{i2}\times F_{i2}+\ldots+K_{im}\times F_{im}$, where abs(x) represents the absolute value of x.

The input-output relationship of a static nonlinear system can be modeled using a non-linear function:

$$y=a_0+a_1x+a_2x^2+\ldots a_Nx^N \tag{1}$$

If the input x to a nonlinear system is a pure sinusoidal tone at frequency F1, then the nonlinear system will produce sinusoidal signals at nF1, n=1, 2, . . . . If the input to a nonlinear system is sum of two sinusoidal tones at frequencies F1 and F2, then the nonlinear system will produce intermodulation products, i.e., sinusoidal signals at frequencies mF1+nF2, where m, n={0, ±1, ±2, . . . }. If the input to a nonlinear system is the sum of three tones at F1, F2, and F3, then the nonlinear system will produce harmonic or intermodulation products at frequencies mF1+nF2+kF3, where m, n, k={0, ±1, ±2, . . . }. The order of the nonlinearity of the system described in Eq. (1) is N. It can be seen that the $p^{th}$-order intermodulation products are caused by the $p^{th}$ term in Eq. (1).

In general, for loudspeakers, estimation of the nonlinear distortion is mainly for evaluating the effect of the nonlinear distortion on auditory perception about audio signals. Therefore, evaluation of the nonlinear distortion involves nonlinear contributions in the audible frequency range. In general, the audible frequency range is from 20 Hz to 22,000 Hz.

The nonlinear distortion may be coincident with the frequency components of the test signal. If some nonlinear distortion products are coincident with the frequency components of the test signal, then they are mixed with the linear contributions of the test signals and cannot be separated from the linear contributions of the test signals.

However, it is possible to generate a test signal to ensure accurate measurements of nonlinear distortion. Embodiments of the invention generates a test signal such that it includes simultaneous harmonic tone signals and the number of harmonic distortion products and the intermodulation distortion products not coincident with the frequencies of the tone signals is much larger than the number of harmonic distortion products and intermodulation distortion products coincident with the frequencies of the tone signals, and hence the total energy measured at harmonic frequencies of the fundamental tone signal but not at the frequencies of the tone signals can approximate to the total energy contributed from the nonlinear distortion, and the total energy measured at the frequencies of the tone signals can approximate to the total energy of linear contribution from the tone signals, with noise not at harmonic frequencies of the fundamental tone signal being excluded from the measurements.

FIG. 1 is a block diagram illustrating an example system 100 for estimating nonlinear distortion of a loudspeaker according to an embodiment of the present invention.

As illustrated in FIG. 1, system 100 includes a signal generator 101, an analyzer 103 and an estimator 104.

Signal generator 101 is configured to generate a test signal T including at least two simultaneous audible tone signals $T_i$. The term "audible" means that the tone signals are within the audible frequency range. One of the tone signals $T_i$ is a fundamental tone signal (e.g., tone signal $T_1$) and each of the rest (e.g., tone signals other than $T_1$) of the tone signals is a harmonic of the fundamental tone signal. Among harmonic distortion products and intermodulation distortion products of the tone signals within the audible frequency range and below a predetermined order Q of nonlinearity, a ratio of the number of the products not at the frequencies of the tone signals to the number of all the products is greater than a predetermined value, e.g., 0.8, 0.85, or 0.90. In the hereafter, the ratio is also called as a separation ratio.

The predetermined order Q of nonlinearity may be any integer number higher than one, and preferably, lower than ten.

With respect to a specific type of the audio signals, signal generator 101 may be configured to generate a test signal where the tone signals of the test signal may be evenly distributed in the frequency range of the audio signal, or may include the most dominant tone signals of the audio signal. In an example, the number of the tone signals in the test signal is three, so as to simulate music signals.

In an example where the test signal includes three tone signals at frequencies $F_1$, $F_2$ and $F_3$, let $$s_0(t)=\sin(2\pi F_1 t+\theta_1)+\sin(2\pi F_2 t+\theta_2)+\sin(2\pi F_3 t+\theta_3),$$

where $\theta_1$, $\theta_2$ and $\theta_3$ are the phases of the tone signals respectively.

Then, the test signal may be generated as $$s(t)=As_0(t)/\max(|s_0(t)|),$$

where A is the amplitude of the test signal, s(t). For example, A is less than or equal to x times the maximal amplitude of audio signals allowed to be fed to the loudspeaker, where x is a number between 0.01 and 0.9.

A loudspeaker may exhibit different nonlinearities for audio signals in different frequency bands. To estimate the nonlinear distortion with respect to a specific frequency band, signal generator 101 may be configured to generate a test signal where at least one of the tone signals of the test signal may be distributed (evenly distributed, if more than one) in the frequency band, or may include all the dominant tone signals in the frequency band of the audio signal, or the most dominant tone signals in the frequency band of the audio signal. For example, in case that the loudspeaker is an electrodynamic loudspeaker, the frequency of the fundamental tone signal may be below the lower cutoff frequency of the loudspeaker, and the frequency of each of the rest of the tone signals is above the lower cutoff frequency. If the frequency of a dominant tone signal is not a harmonic frequency of the fundamental tone signal of the test signal, the test signal may include a tone signal with harmonic frequency close to the frequency of the dominant tone signal.

For an audio signal including more tone signals, a test signal including a larger number of tone signals may be beneficial for simulating the audio signal. However, the larger number of tone signals of a test signal may reduce the separation ratio. There is a tradeoff between the number of the tone signals and the separation ratio d.

If the separation ratio is larger, the nonlinear distortion estimated accordingly may be closer to the real nonlinear distortion. Therefore, it is preferable to generate a test signal with the separation ratio as higher as possible. For example, if the number U of the tone signals is determined, it is possible to generate a set of possible signals $P_1$ to $P_V$. Each possible signal $P_i$ includes a fundamental tone signal $T_{i,1}$ and other tone signals $T_{i,2}$ to $T_{i,U}$ with frequencies $F_{i,1}$ to $F_{i,U}$ respectively, where $F_{i,j-1}\times F_{i,1}$, j>1. Because the tone signals are audible, each has a limited value. Each possible signal $P_i$ has a unique combination of $F_{i,1}$, $K_{i,1}$, . . . , and $K_{i,U-1}$. Accordingly, it is possible to calculate the separation ratio for each possible signal $P_i$. From the possible signals with separation ratio greater than a predetermined value, e.g., 0.8, 0.85, or 0.90, one possible signal, preferably with higher separation ratio, or the highest separation ratio, may be used as the test signal.

The possible signal where one of the following numbers is zero may be used: the number of the 3rd-order products at frequencies of the tone signals; the number of the 3rd-order and 4th-order products at frequencies of the tone signals; the number of the 3rd-order, 4th-order and 5th-order products at frequencies of the tone signals.

Figure 2:
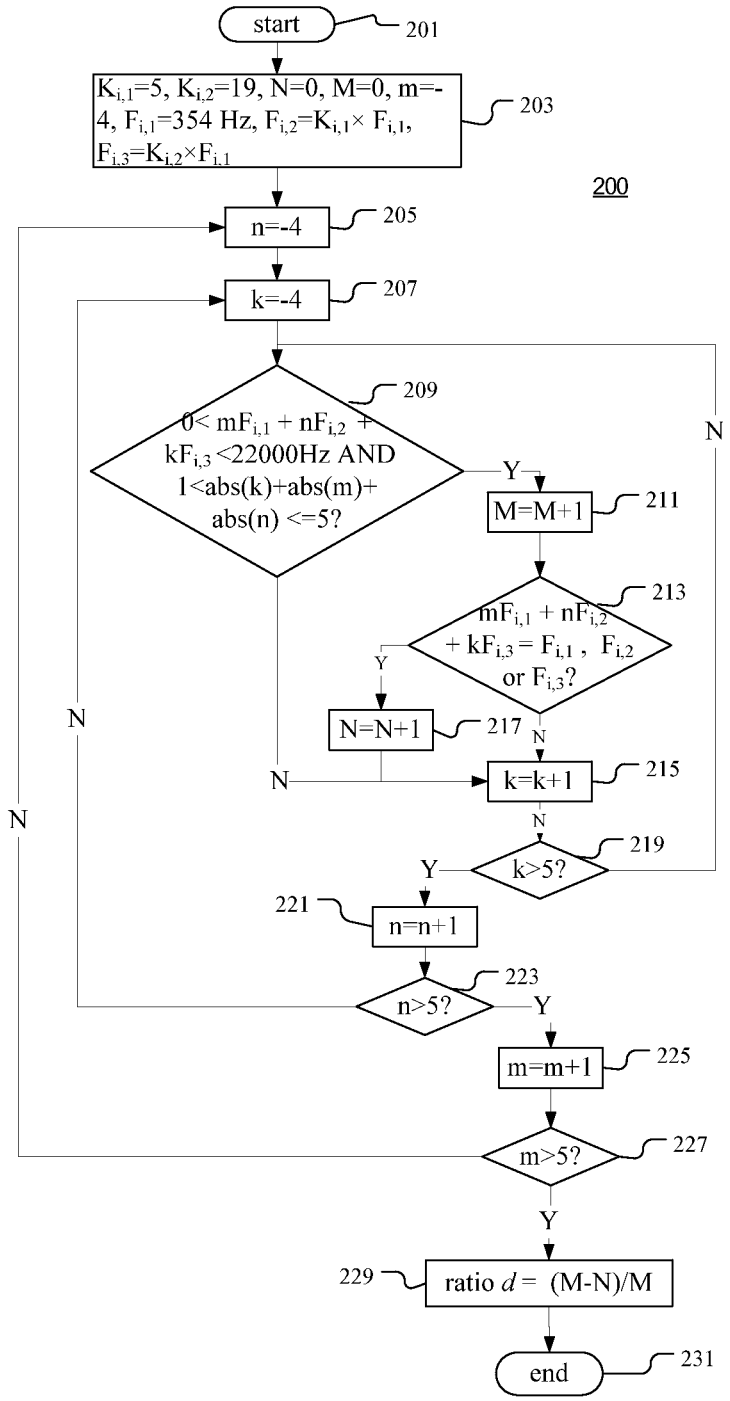
FIG. 2 is a flow chart illustrating an example method of calculating the separation ratio for a possible test signal.

FIG. 2 is a flow chart illustrating an example method 200 of calculating the separation ratio of a possible signal $P_i$. The possible signal $P_i$ includes three tone signals $T_{i,1}$, $T_{i,2}$ and $T_{i,3}$ with frequencies $F_{i,1}$, $F_{i,2}$ and $F_{i,3}$, respectively. $F_{i,1}$=354 Hz. $K_{i,1}$=5, $K_{i,2}$=19. The predetermined order of nonlinearity is 5. Because a factor of −5 in the linear combination produces an intermodulation distortion product at a negative frequency, the factor of −5 is ignored.

As illustrated in FIG. 2, method 200 starts from step 201. At step 203, variables are set, where $K_{i,1}$=5, $K_{i,2}$=19, N=0, M=0, m=−4, $F_{i,1}$=354 Hz, $F_{i,2}=K_{i,1}\times F_{i,1}$, $F_{i,3}=K_{i,2}\times F_{i,1}$. M represents the number of harmonic distortion products and intermodulation distortion products of the tone signals $T_{i,1}$, $T_{i,2}$ and $T_{i,3}$ within a specified audible frequency range and below a predetermined order of nonlinearity. N represents the number of those products at the frequencies $F_{i,1}$, $F_{i,2}$ and $F_{i,3}$ among the M products.

At step 205, set variable n=−4. At step 207, set variable k=−4.

At step 209, it is determined whether the condition of $0<mF_{i,1}+nF_{i,2}+kF_{i,3}<22000$ Hz and 1<abs(k)+abs(m)+abs(n)≤5 is met. If the condition is met, the method proceeds to step 211. If the condition is not met, the method proceeds to step 215. At step 211, set M=M+1. At step 213, it is determined whether the condition of $mF_{i,1}+nF_{i,2}+kF_{i,3}=F_{i,1}$, $F_{i,2}$ or $F_{i,3}$ is met. If the condition is met, at step 217, set N=N+1 and the method proceeds to step 215. If the condition is not met, the method proceeds to step 215.

At step 215, set k=k+1. At step 219, it is determined whether k is greater than 5. If k is not greater than 5, the method returns to step 209. If k is greater than 5, the method proceeds to step 221.

At step 221, set n=n+1. At step 223, it is determined whether n is greater than 5. If n is not greater than 5, the method returns to step 207. If n is greater than 5, the method proceeds to step 225.

At step 225, set m=m+1. At step 227, it is determined whether m is greater than 5. If m is not greater than 5, the method returns to step 205. If m is greater than 5, the method proceeds to step 229.

At step 229, the separation ratio d is calculated as (M−N)/M. Then the method ends at step 231.

As the result of executing method 200, N=5, M=104, and the separation ratio d is (M−N)/M=99/104=95.19%. For this test signal, the Fourier transform bins containing $2^{nd}$~$5^{th}$-order nonlinear distortion products are listed below, where binI means the bin at frequency $I\times F_1$, (m, n, k) means the linear combination $mF_{i,1}+nF_{i,2}+kF_{i,3}$ of three tone signals, and those products at the frequencies of the three tone signals (which are at bin1, bin5 and bin19) are underlined. As shown below, there are N=5 intermodulation products coincident with the tone signals of the test signal. For example, bin1 (−4, 1, 0) in $5^{th}$-order nonlinear distortion products below means that the distortion product at frequency $-4\times F_{i,1}+1\times F_{i,2}+0\times F_{i,3}=-4\times F_{i,1}+1\times 5\times F_{i,1}=1\times F_{i,1}$ is contained in bin1, coincident with the lowest tone signal in the test signal.

List of $2^{nd}$~$5^{th}$-order nonlinear products and their spectral bins (at harmonics of $F_{i,1}$):

$2^{nd}$-order nonlinear distortion products: bin2 (2, 0, 0); bin4 (−1, 1, 0); bin6 (1, 1, 0); bin10 (0, 2, 0); bin14 (0, −1, 1); bin18 (−1, 0, 1); bin20 (1, 0, 1); bin24 (0, 1, 1); bin38 (0, 0, 2);

$3^{rd}$-order nonlinear distortion products: bin3 (−2, 1, 0); bin3 (3, 0, 0); bin7 (2, 1, 0); bin9 (−1, 2, 0); bin9 (0, −2, 1); bin11 (1, 2, 0); bin13 (−1, −1, 1); bin15 (0, 3, 0); bin15 (1, −1, 1); bin17 (−2, 0, 1); bin21 (2, 0, 1); bin23 (−1, 1, 1); bin25 (1, 1, 1); bin29 (0, 2, 1); bin33 (0, −1, 2); bin37 (−1, 0, 2); bin39 (1, 0, 2); bin43 (0, 1, 2); bin57 (0, 0, 3);

$4^{th}$-order nonlinear distortion products: bin2 (−3, 1, 0); bin4 (0, −3, 1); bin4 (4, 0, 0); bin8 (−2, 2, 0); bin8 (−1, −2, 1); bin8 (3, 1, 0); bin10 (1, −2, 1); bin12 (−2, −1, 1); bin12 (2, 2, 0); bin14 (−1, 3, 0); bin16 (−3, 0, 1); bin16 (1, 3, 0); bin16 (2, −1, 1); bin20 (0, 4, 0); bin22 (−2, 1, 1); bin22 (3, 0, 1); bin26 (2, 1, 1); bin28 (−1, 2, 1); bin28 (0, −2, 2); bin30 (1, 2, 1); bin32 (−1, −1, 2); bin34 (0, 3, 1); bin34 (1, −1, 2); bin36 (−2, 0, 2); bin40 (2, 0, 2); bin42 (−1, 1, 2); bin44 (1, 1, 2); bin48 (0, 2, 2); bin52 (0, −1, 3); bin56 (−1, 0, 3); bin58 (1, 0, 3); bin62 (0, 1, 3);

$5^{th}$-order nonlinear distortion products: bin1 (−4, 1, 0); bin1 (0, 4, −1); bin3 (−1, −3, 1); bin5 (1, −3, 1); bin5 (5, 0, 0); bin7 (−3, 2, 0); bin7 (−2, −2, 1); bin9 (4, 1, 0); bin11 (−3, −1, 1); bin11 (2, −2, 1); bin13 (−2, 3, 0); bin13 (3, 2, 0); bin15 (−4, 0, 1); bin17 (2, 3, 0); bin17 (3, −1, 1); bin19 (−1, 4, 0); bin21 (−3, 1, 1); bin21 (1, 4, 0); bin23 (0, −3, 2); bin23 (4, 0, 1); bin25 (0, 5, 0); bin27 (−2, 2, 1); bin27 (−1, −2, 2); bin27 (3, 1, 1); bin29 (1, −2, 2); bin31 (−2, −1, 2); bin31 (2, 2, 1); bin33 (−1, 3, 1); bin35 (−3, 0, 2); bin35 (1, 3, 1); bin35 (2, −1, 2); bin39 (0, 4, 1); bin41 (−2, 1, 2); bin41 (3, 0, 2); bin45 (2, 1, 2); bin47 (−1, 2, 2); bin47 (0, −2, 3); bin49 (1, 2, 2); bin51 (−1, −1, 3); bin53 (0, 3, 2); bin53 (1, −1, 3); bin55 (−2, 0, 3); bin59 (2, 0, 3); bin61 (−1, 1, 3).

In method 200, $K_{i,2}$ may also be set to 13.

In an alternative embodiment, for each possible test signal, each of the tone signals other than the fundamental tone signal is an odd harmonic of the fundamental tone signal.

Returning to FIG. 1, the test signal is played through a loudspeaker 105. Loudspeaker 105 converts the test signal into sounds.

Analyzer 103 is configured to perform a spectral analysis on the response of the loudspeaker to the test signal. The response can be captured through a microphone 106.

Estimator 104 is configured to estimate a nonlinear distortion value by regarding the energy at harmonic frequencies of the fundamental tone signal but not at the frequencies of the tone signals as contribution from the nonlinear distortion. Various expressions can be used to represent the nonlinear distortion value. For example, the nonlinear distortion value NLD may be estimated as the square root of the ratio of the total energy at harmonic frequencies of the fundamental tone signal but not at the frequencies of the tone signals to the total energy at frequencies of the tone signals.

In an example where the test signal includes three tone signals at frequencies $F_1$, $mF_1$ and $nF_1$, $$NLD = 100\%\sqrt{\frac{E(F_1)+E(2F_1)+E(3F_1)+\ldots}{E(F_1)+E(mF_1)+E(nF_1)}-1}$$

where $E(kF_1)$ is the energy at frequency $kF_1$ observed from the measurement microphone.

Figure 3:
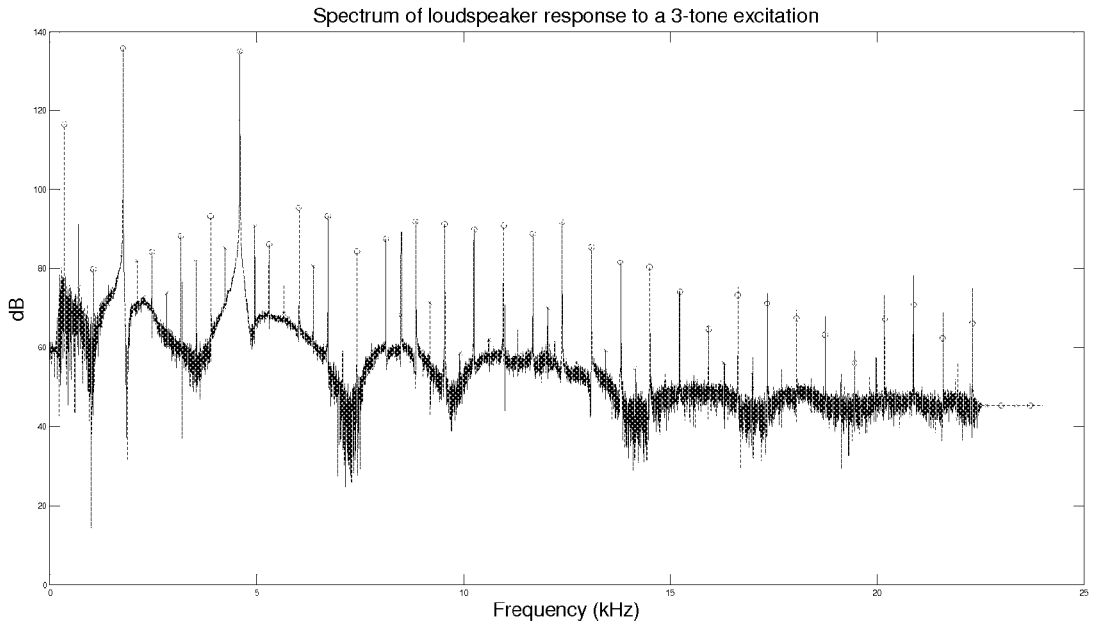
FIG. 3 is a graph illustrating an example of measured spectrum of a loudspeaker response to a test signal.

According to the embodiments of the present invention, the frequencies of nonlinear distortion products are located at frequencies $k\times F_1$. This makes the measurement of nonlinear distortions less affected by background noise because only noise at k×F1 is mixed with the nonlinear distortion products, while noise at other bins is not taken into account. Experimental results obtained in a typical room show that the nonlinear distortion components (spikes below the 3 highest spikes) as shown in FIG. 3 are much stronger than the noise floor of the measurement signal.

The nonlinear distortion of a loudspeaker to the test signal may be affected by the crest factor, which is determined by the relative phases of the tone signals of the test signal. Therefore, it is desirable to design the phases to represent input signals over a wide range. For example, it is possible to set the phases of the tone signals as independent random numbers uniformly distributed in the range (0, 2π), and multiple test signals different only in the phases are generated independently. The averaged nonlinear distortion values based on the multiple test signals is used as the measure of nonlinear distortion of the loudspeaker.

In a further embodiment of system 100, signal generator 101 may be further configured to generate another test signal which is different only in the phase of at least one of the tone signals. The other test signal is played from the loudspeaker. Analyzer 103 may be further configured to perform another spectral analysis on the response of the loudspeaker to the other test signal. Estimator 104 may be further configured to estimate another nonlinear distortion value by regarding the energy at harmonic frequencies of the fundamental tone signal but not at the frequencies of the tone signals as contribution from the nonlinear distortion.

By doing in this way, at least two nonlinear distortion values can be estimated. Estimator 104 may be further configured to average all the estimated nonlinear distortion values to obtain a more robust result.

The number of the nonlinear distortion values to be averaged may be two or more. In a preferred embodiment, the number of the nonlinear distortion values to be averaged is 6.

Figure 4:
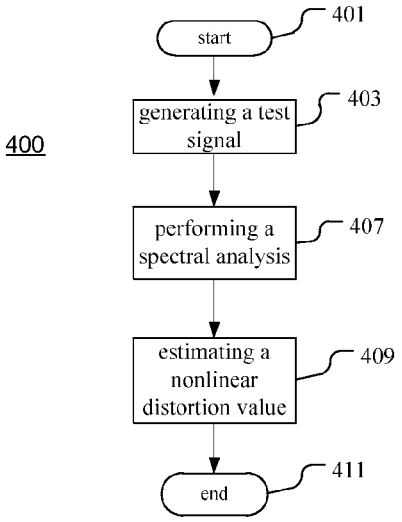
FIG. 4 is a flow chart illustrating an example method of estimating nonlinear distortion of a loudspeaker according to an embodiment of the present invention.

FIG. 4 is a flow chart illustrating an example method 400 of estimating nonlinear distortion of a loudspeaker according to an embodiment of the present invention.

As illustrated in FIG. 4, method 400 starts from step 401. At step 403, a test signal T including at least two simultaneous audible tone signals $T_i$ is generated. One of the tone signals $T_i$ is a fundamental tone signal (e.g., tone signal $T_1$) and each of the rest (e.g., tone signals other than $T_1$) of the tone signals is a harmonic of the fundamental tone signal. Among harmonic distortion products and intermodulation distortion products of the tone signals within a specified audible frequency range and below a predetermined order Q of nonlinearity, the separation ratio is greater than a predetermined value, e.g., 0.8, 0.85, or 0.90.

Audio signals such as music signals and speech signal may include a number of tone signals. With respect to a specific type of the audio signals, it is possible to generate a test signal where the tone signals of the test signal may be evenly distributed in the frequency range of the audio signal, or may include all the dominant tone signals of the audio signal, or the most dominant tone signals of the audio signal. If the frequency of a dominant tone signal is not a harmonic frequency of the fundamental tone signal of the test signal, the test signal may include a tone signal with harmonic frequency close to the frequency of the dominant tone signal. In an example, the number of the tone signals is three, so as to simulate music signals. For example, the tone signals may have frequencies $F_1$, $F_2=K\times F_1$, $F_3=P\times F_1$ respectively, where (K, P)=(5,13), (5,19), (7,23), or (13, 21).

In an example where the test signal includes three tone signals at frequencies $F_1$, $F_2$ and $F_3$, let $$s_0(t)=\sin(2\pi F_1 t+\theta_1)+\sin(2\pi F_2 t+\theta_2)+\sin(2\pi F_3 t+\theta_3),$$

where $\theta_1$, $\theta_2$ and $\theta_3$ are the phases of the tone signals respectively.

Then, the test signal may be generated as $$s(t)=As_0(t)/\max(|s_0(t)|),$$

where A is the amplitude of the test signal, s(t). For example, A is less than or equal to x times the maximal amplitude of audio signals allowed to be fed to the loudspeaker, where x is a number between 0.01 and 0.9.

A loudspeaker may exhibit different nonlinearities for audio signals in different frequency bands. To estimate the nonlinear distortion with respect to a specific frequency band, it is possible to generate a test signal where at least one of the tone signals of the test signal may be distributed (evenly distributed, if more than one) in the frequency band, or may include all the dominant tone signals in the frequency band of the audio signal, or the most dominant tone signals in the frequency band of the audio signal. For example, in case that the loudspeaker is an electro-dynamic loudspeaker, the frequency of the fundamental tone signal may be below the lower cutoff frequency of the loudspeaker, and the frequency of each of the rest of the tone signals is above the lower cutoff frequency. If the frequency of a dominant tone signal is not a harmonic frequency of the fundamental tone signal of the test signal, the test signal may include a tone signal with harmonic frequency close to the frequency of the dominant tone signal.

For an audio signal including more tone signals, a test signal including a larger number of tone signals may be beneficial for simulating the audio signal. However, the larger number of tone signals of a test signal may reduce the separation ratio of the tone signals. There is a tradeoff between the number of the tone signals and the separation ratio of the tone signals.

Because the order of harmonics is greater than 1, it is implied that the predetermined order Q of nonlinearity is above 2. Further, the predetermined order Q of nonlinearity may be dependent on the frequencies of the tone signals of the test signal. As stated in the above, for loudspeakers, the estimation of the nonlinear distortion is mainly for evaluating the effect of the nonlinear distortion on auditory perception about audio signals. Therefore, evaluation of the nonlinear distortion involves nonlinear contributions in the audible frequency range. A larger predetermined order Q of nonlinearity may increase the number of the intermodulation distortion products exceeding the audible frequency range, and reduce the effectiveness of the test signal. In an example, the predetermined order Q of nonlinearity may be any integer number higher than one, and preferably, lower than ten.

If the separation ratio is larger, the nonlinear distortion estimated accordingly may be closer to the real nonlinear distortion. Therefore, it is preferable to generate a test signal with the separation ratio as higher as possible. For example, if the number U of the tone signals is determined, it is possible to generate a set of possible signals $P_1$ to $P_V$. Each possible signal $P_i$ includes a fundamental tone signal $T_{i,1}$ and other tone signals $T_{i,2}$ to with frequencies $F_{i,1}$ to $F_{i,U}$ respectively, where $F_{i,j}=K_{i,j-1}\times F_{i,1}$, j>1. Because the tone signals are audible, each $K_{i,j-1}$ has a limited value. Each possible signal $P_i$ has a unique combination of $F_{i,1}$, $K_{i,1}$, . . . , and $K_{i,U-1}$. Accordingly, it is possible to calculate the separation ratio for each possible signal $P_i$. From the possible signals with separation ratio greater than a predetermined value, e.g., 0.8, 0.85, or 0.90, one possible signal, preferably with higher separation ratio, or the highest separation ratio, may be used as the test signal.

The possible signal where one of the following numbers is zero may be used: the number of the 3rd-order products at frequencies of the tone signals; the number of the 3rd-order and 4th-order products at frequencies of the tone signals; the number of the 3rd-order, 4th-order and 5th-order products at frequencies of the tone signals.

In an alternative embodiment, for each possible signal, each of the tone signals other than the fundamental tone signal is an odd harmonic of the fundamental tone signal.

The generated test signal may be played through the loudspeaker.

At step 407, a spectral analysis is performed on the response of the loudspeaker to the generated test signal.

At step 409, a nonlinear distortion value is estimated by regarding the energy at harmonic frequencies of the fundamental tone signal but not at the frequencies of the tone signals as contribution from the nonlinear distortion. Various expressions can be used to represent the nonlinear distortion value. For example, the nonlinear distortion value NLD may be estimated as the square root of the ratio of the total energy at harmonic frequencies of the fundamental tone signal but not at the frequencies of the tone signals to the total energy at frequencies of the tone signals.

In an example where the generated test signal includes three tone signals at frequencies $F_1$, $mF_1$ and $nF_1$, $$NLD = 100\%\sqrt{\frac{E(F_1)+E(2F_1)+E(3F_1)+\ldots}{E(F_1)+E(mF_1)+E(nF_1)}-1}$$

where $E(kF_1)$ is the energy at frequency $kF_1$ observed from the measurement microphone.

Method Ends at Step 411.

The nonlinear distortion of a loudspeaker to the test signal may be affected by the crest factor, which is determined by the relative phases of the tone signals of the test signal. Therefore, it is desirable to design the phases to represent input signals over a wide rage. For example, it is possible to set the phases of the tone signals as independent random numbers uniformly distributed in the range (0, 2π), and multiple test signals different only in the phases are generated independently. The averaged nonlinear distortion values based on the multiple test signals is used as the measure of nonlinear distortion of the loudspeaker.

Figure 5:
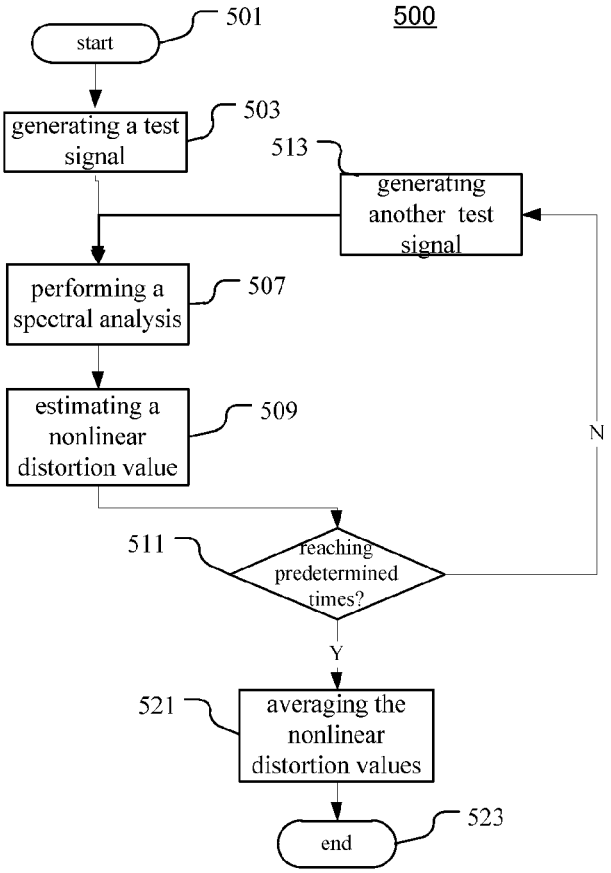
FIG. 5 is a flow chart illustrating a further example of the method of FIG. 4.

FIG. 5 is a flow chart illustrating a further example of the method of FIG. 4.

In method 500 as illustrated in FIG. 5, steps 501, 503, 507 and 509 have the same function as steps 401, 403, 407 and 409, and will not be described in detail herein.

As illustrated in FIG. 5, after step 509, at step 511, it is determined whether a predetermined number of nonlinear distortion values have been estimated. If not, method 500 proceeds to step 513. If the predetermined number of nonlinear distortion values has been estimated, method 500 proceeds to step 521.

At step 513, another test signal which is different only in the phase of at least one of the tone signals is generated. Accordingly, steps 507 and 509 are executed again to estimate another nonlinear distortion value with respect to the test signal generated at step 513.

At step 521, because the predetermined number of nonlinear distortion values has been estimated, all the estimated nonlinear distortion values are averaged.

Then method 500 ends at step 523.

The number of the nonlinear distortion values to be averaged may be two or more. In a preferred embodiment, the number of the nonlinear distortion values to be averaged is 6.

Tuning Parameter for Boosting

The sound power that can be produced from an electro-dynamic loudspeaker varies with frequency and the size of the vibration surface of the loudspeaker. At frequencies lower than the lower cutoff frequency, the sound power may drop at a rate of 6 dB/Oct as frequency decreases. The smaller size is the loudspeaker, the more difficult is for it to produce low frequency sounds. There is a method to make the loudspeaker produce more sound power at low frequencies below its lower cutoff frequency by boosting the low-frequency components in audio signals before feeding them to the loudspeaker. In this method, one or more parameters may affect the boosting.

Figure 6:
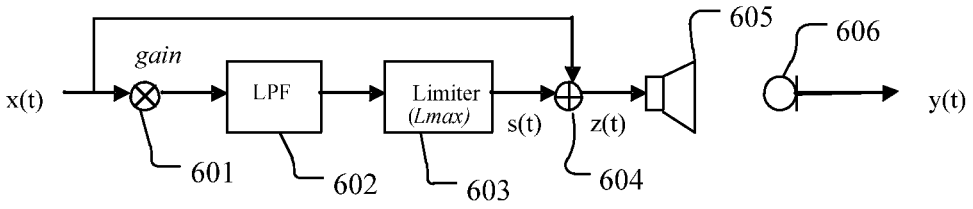
FIG. 6 is a schematic view for illustrating an example implementation of a method of boosting the low-frequency components of audio signals.

One example implementation of the method is illustrated in FIG. 6. As illustrated in FIG. 6, original input signal x(t) is amplified by a multiplier 601 with a gain. The amplified signal passes through a low pass filter 602. The filtered signal, with frequency components below the lower cutoff frequency of the loudspeaker being boosted, passes through a limiter 603 to suppress large amplified low-frequency components. The output of the limiter s(t) is added by an adder 604 with the original input signal x(t), and the sum z(t) is used to drive a loudspeaker 605. The maximal output level Lmax of limiter 603 and the gain for the multiplier 601 are examples of the parameters for boosting.

However, driving a loudspeaker with low-frequency components boosted audio signals may force the cone and moving coil of the loudspeaker to vibrate over an excursion beyond its normal mechanical or magnetic range and produce more nonlinear distortions than without the boosting, and may even damage the loudspeaker if the maximal output level of the limiter (Lmax) is not properly set.

The nonlinear distortion observed from y(t) (captured through microphone 606) is dominated by the nonlinearity of the loudspeaker, and such nonlinear distortions increases as the amplitude of z(t) increases, or as Lmax of the limiter and the amplitude of input x(t) increase. This means that if a nonlinear loudspeaker plays musical harmonics, it will produce enormous amount of distortion products that are not harmonically related to the original musical harmonics, and deteriorate the perceived quality of the musical sounds played.

It is desired to set the parameters to increase the boosting to the maximal extent without audibly increasing the nonlinear distortion in the output of the electro-dynamic loudspeaker, in comparison with the nonlinear distortion in the output of the electro-dynamic loudspeaker without the boosting.

Figure 7:
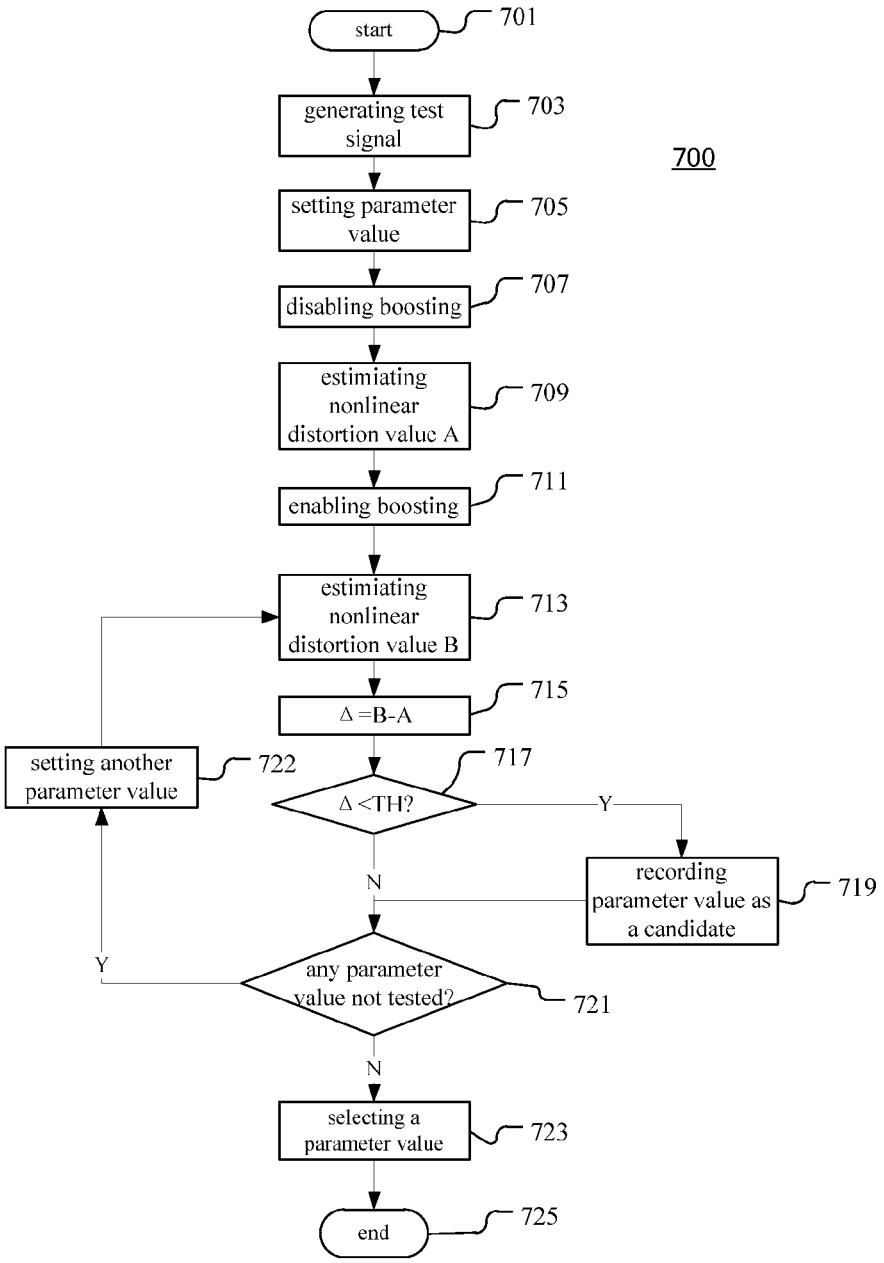
FIG. 7 is a flow chart schematically illustrating an example process of tuning a parameter for boosting sounds below the lower cutoff frequency of an electro-dynamic loudspeaker.

FIG. 7 is a flow chart schematically illustrating an example process of tuning a parameter for boosting sounds below the lower cutoff frequency of an electro-dynamic loudspeaker.

As illustrated in FIG. 7, the process starts from step 701. At step 703, a test signal is generated. At step 705, the parameter is set to a parameter value. The parameter value may be one of at least one values not tested yet. At step 707, the boosting is disabled. At step 709, the test signal is played through the loudspeaker and a nonlinear distortion value A is estimated through the method described in the Estimating Nonlinear Distortion section. At step 711, the boosting is enabled. At step 713, the test signal is played through the loudspeaker and a nonlinear distortion value B is estimated through the method described in the Estimating Nonlinear Distortion section. At step 715, a difference Δ=B−A is calculated according to the following equation:

$$\Delta = NLD_{boosting\ enabled} - NLD_{boosting\ disabled}$$

At step 717, it is determined whether the difference Δ is lower than a threshold TH. If Δ<TH, at step 719, the parameter value currently tested is recorded as a candidate, and the process proceeds to step 721. If Δ≥TH, the process proceeds to step 721. At step 721, it is determined whether there is any parameter values not tested yet. If any, at step 722, the parameter is set to a parameter value not test yet, and the process returns to step 713 to estimate a nonlinear distortion value B in case of enabling the boosting. If no, at step 723, one of the candidates (if any) is selected as the parameter value to be used. The process ends at step 725. Because different settings of parameter values have no effect on the estimation of the nonlinear distortion value A in case of disabling the boosting, the nonlinear distortion value A estimated at step 709 may be used at steps 715 for different settings of parameter values. It should be noted that, although one parameter is set in the embodiments, the number of parameters to be set is not limited to one. The parameter to be set may also comprise a combination of parameters.

Specific embodiments for tuning the parameter will be described in the following.

Figure 8A:
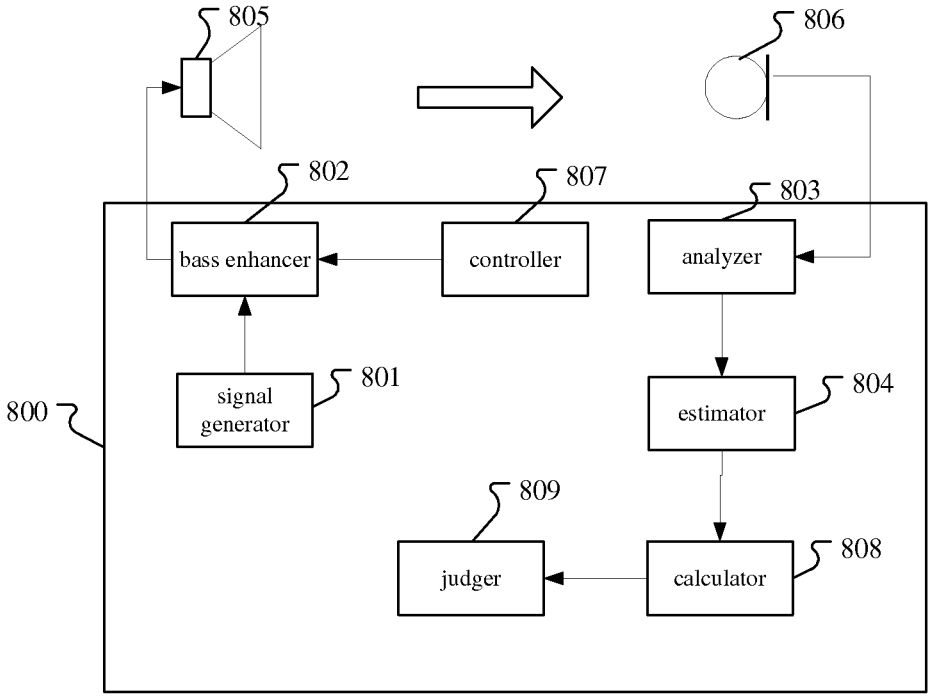
FIG. 8A is a block diagram illustrating an example system for tuning a parameter for boosting sounds below the lower cutoff frequency of an electro-dynamic loudspeaker according to an embodiment of the present invention.

FIG. 8A is a block diagram illustrating an example system 800 for tuning a parameter for boosting sounds below the lower cutoff frequency of an electro-dynamic loudspeaker according to an embodiment of the present invention.

As illustrated in FIG. 8A, system 800 includes a signal generator 801, a bass enhancer 802, an analyzer 803, an estimator 804, a controller 807, a calculator 808 and a judger 809.

Controller 807 is configured to set the parameter to a parameter value.

Signal generator 801 has the same function as signal generator 101, and will not be described in detail herein.

Bass enhancer 802 is configured to process the test signal in case of enabling the boosting and not to process the test signal in case of disabling the boosting. In case of enabling the boosting, bass enhancer 802 may boost sounds below the lower cutoff frequency of loudspeaker 805 according to one or more parameters.

Figure 8B:
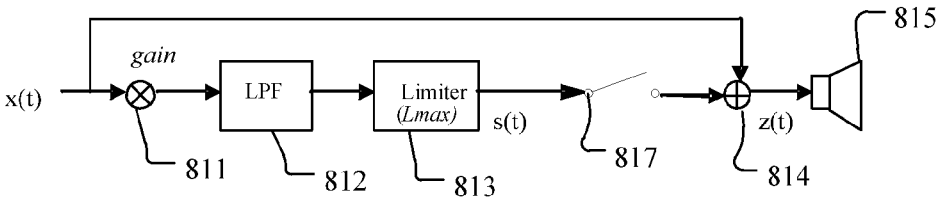
FIG. 8B is a block diagram illustrating an example implementation of the bass enhancer in the embodiment of FIG. 8A.

FIG. 8B is a block diagram illustrating an example implementation of the bass enhancer 802 in the embodiment of FIG. 8A. As illustrated in FIG. 8B, bass enhancer 802 may include multiplier 811, low pass filter 812, limiter 813, adder 814 and a switcher 817 for switching on or off the boosting path to enable or disable the boosting under the control of controller 807. Multiplier 811, low pass filter 812, limiter 813 and adder 814 have the same function as that of multiplier 601, low pass filter 602, limiter 603 and adder 604 respectively, and will not be described in detail herein. In case of disabling the boosting, that is, switching off switcher 817, the original test signal is played through the loudspeaker.

Analyzer 803 is configured to perform spectral analyses on the responses of the loudspeaker to the test signal in the two cases respectively. The method of performing a spectral analysis on each response is the same as that of analyzer 103, and will not be described in detail herein.

Estimator 804 is configured to estimate nonlinear distortion values by regarding the energy at harmonic frequencies of the fundamental tone signal but not at the frequencies of the tone signals as contribution from the nonlinear distortion in the two cases respectively. The method of estimating a nonlinear distortion value in each case is the same as that of estimator 104, and will not be described in detail herein.

Calculator 808 is configured to calculate a difference by subtracting the nonlinear distortion value estimated in case of disabling the boosting from the nonlinear distortion value estimated in case of enabling the boosting based on the setting of the parameter value. It should be noted that, the difference is calculated according to the nonlinear distortion values estimated under each setting of the parameter value.

Judger 809 is configured to accept the parameter value if the calculated distortion difference is lower than a threshold.

The threshold may be an estimated value. For example, in case that the nonlinear distortion value is estimated as the square root of the ratio of the total energy at harmonic frequencies of the fundamental tone signal but not at the frequencies of the tone signals to the total energy at frequencies of the tone signals, the threshold may be 0.3. Alternatively, in case that the parameter is manually tuned by a specialist through a subjective listening and tuning, it is possible to estimate nonlinear distortion values when the specialist turns on the boosting and listens to the low-frequency boosted musical signals z(t) played through the loudspeaker, and when the specialist turns off the boosting and listens to the musical signal x(t) played through the same loudspeaker. If the specialist accepts the setting, the difference between the nonlinear distortion values can be recorded as a sample. Through a statistical model, the threshold can be obtained based on the samples.

In a further embodiment of system 800, controller 807 may be further configured to set the parameter to each untested one of at least one other parameter value.

Bass enhancer 802 may be further configured to process the test signal in case of enabling the boosting in response to the setting of the untested parameter value and not to process the test signal in case of disabling the boosting.

Analyzer 803 may be further configured to perform a spectral analysis on the response of loudspeaker 805 to the test signal in case of enabling the boosting in response to the setting of the untested parameter value.

Estimator 804 may be further configured to estimate a nonlinear distortion value in case of enabling the boosting by regarding the energy at harmonic frequencies of the fundamental tone signal but not at the frequencies of the tone signals as contribution from the nonlinear distortion in response to the setting of the untested parameter value.

Calculator 808 may be further configured to calculate a difference by subtracting the nonlinear distortion value estimated in case of disabling the boosting from the nonlinear distortion value estimated in case of enabling the boosting based on the setting of the untested parameter value.

Before the operation of judger 809, more than one parameter values may be tested and more than one corresponding differences may be calculated. Judger 809 may be further configured to, with respect to the differences lower than the threshold and their corresponding parameter values, accept one of the corresponding parameter values.

Judger 809 may accept any one of the corresponding parameter values. Preferably, judger 809 may accept the one that increases the boosting to the largest extent.

In a further embodiment of system 800, signal generator 801 may be further configured to generate another test signal which is different only in the phase of at least one of the tone signals. Bass enhancer 802 may be further configured to process the other test signal in case of enabling the boosting and not to process the other test signal in case of disabling the boosting. Analyzer 803 may be further configured to perform other spectral analyses on the outputs of the loudspeaker in the two cases respectively. Estimator 804 may be further configured to estimate other nonlinear distortion values by regarding the energy at harmonic frequencies of the fundamental tone signal but not at the frequencies of the tone signals as contribution from the nonlinear distortion in the two cases respectively. Calculator 808 may be further configured to average all the nonlinear distortion values estimated based on the same setting of parameter value and the different test signals in case of enabling the boosting as the nonlinear distortion value estimated in case of enabling the boosting, and average all the nonlinear distortion and the other nonlinear distortion estimated based on the same setting of parameter value and the different test signals in case of disabling the boosting as the nonlinear distortion estimated in case of disabling the boosting.

It can be understood that the above operations of signal generator 801, bass enhancer 802, analyzer 803 and estimator 804 based on the other test signal are also performed based on the same setting of parameter value as the previous test signal.

Figure 9:
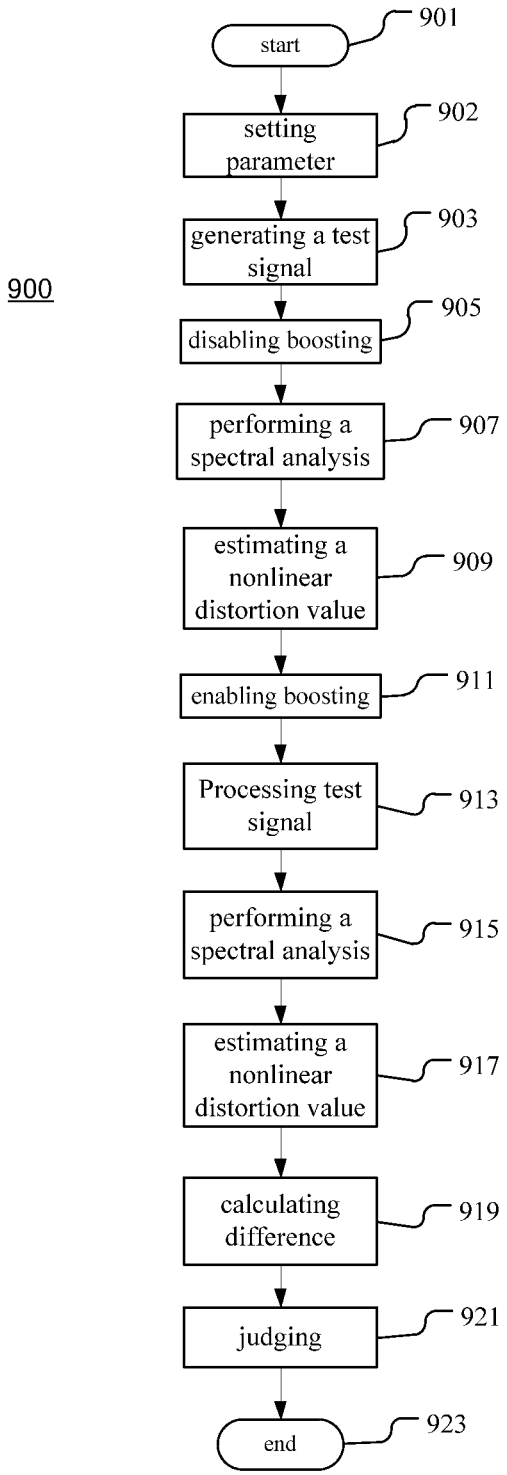
FIG. 9 is a flow chart illustrating an example method of tuning a parameter for boosting sounds below the lower cutoff frequency of an electro-dynamic loudspeaker according to an embodiment of the present invention.

FIG. 9 is a flow chart illustrating an example method 900 of tuning a parameter for boosting sounds below the lower cutoff frequency of an electro-dynamic loudspeaker according to an embodiment of the present invention.

As illustrated in FIG. 9, method 900 starts from step 901. At step 902, the parameter is set to a parameter value.

Step 903 has the same function as step 403, and will not be described in detail herein.

At step 905, the boosting is disabled. Accordingly, the generated test signal is played through the loudspeaker in case of disabling the boosting.

At step 907, a spectral analysis is performed on the response of the loudspeaker to the test signal in case of disabling the boosting. The method of performing a spectral analysis on the response is the same as that of step 407, and will not be described in detail herein.

At step 909, a nonlinear distortion value is estimated by regarding the energy at harmonic frequencies of the fundamental tone signal but not at the frequencies of the tone signals as contribution from the nonlinear distortion in case of disabling the boosting. The method of estimating a nonlinear distortion value is the same as that of step 409, and will not be described in detail herein.

At step 911, the boosting is enabled.

At step 913, the generated test signal is processed, that is to say, sounds below the lower cutoff frequency of loudspeaker are boosted according to the parameter. Accordingly, the generated test signal is played through the loudspeaker in case of enabling the boosting.

At step 915, a spectral analysis is performed on the response of the loudspeaker to the test signal in case of enabling the boosting.

At step 917, a nonlinear distortion value is estimated by regarding the energy at harmonic frequencies of the fundamental tone signal but not at the frequencies of the tone signals as contribution from the nonlinear distortion in case of enabling the boosting.

At step 919, a difference is calculated by subtracting the nonlinear distortion value estimated in case of disabling the boosting from the nonlinear distortion value estimated in case of enabling the boosting based on the setting of the parameter value. It should be noted that, the difference is calculated according to the nonlinear distortion values estimated under each setting of the parameter value.

At step 921, the parameter value is accepted if the difference is lower than a threshold. The method ends at step 923.

The threshold may be an estimated value. For example, in case that the nonlinear distortion value is estimated as the square root of the ratio of the total energy at harmonic frequencies of the fundamental tone signal but not at the frequencies of the tone signals to the total energy at frequencies of the tone signals, the threshold may be 0.3. Alternatively, in case that the parameter is manually tuned by a specialist through a subjective listening and tuning, under the same parameter setting, it is possible to estimate nonlinear distortion values when the specialist turns on the boosting and listens to the low-frequency boosted musical signals z(t) through the loudspeaker, and when the specialist turns off the boosting and listens to the musical signal x(t) through the same loudspeaker. If the specialist accepts the setting, the difference between the nonlinear distortion values can be recorded as a sample. Through a statistical model, the threshold can be obtained based on the samples.

Figure 10:
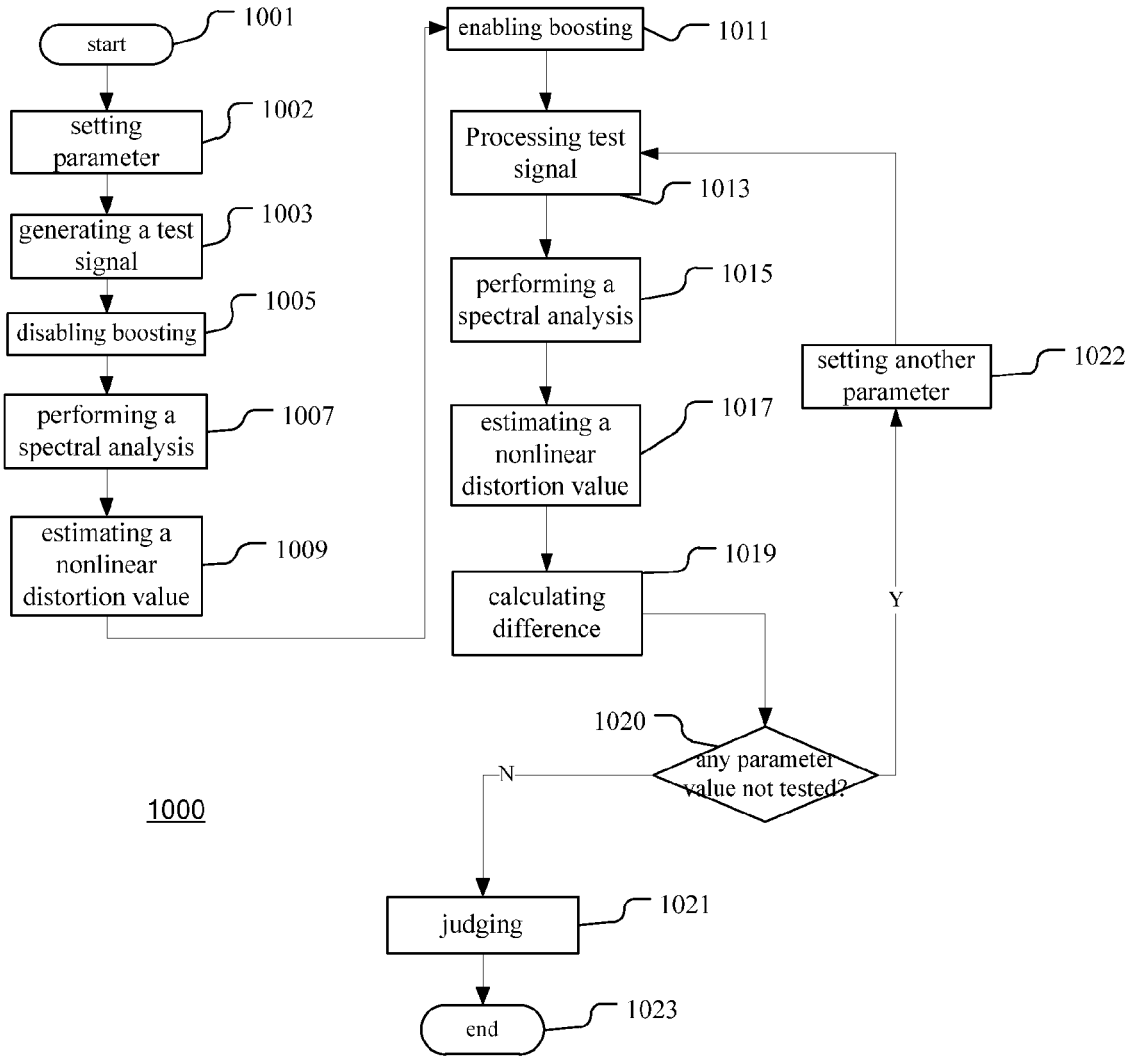
FIG. 10 is a flow chart illustrating an example method of tuning a parameter for boosting sounds below the lower cutoff frequency of an electro-dynamic loudspeaker according to an embodiment of the present invention.

FIG. 10 is a flow chart illustrating an example method 1000 of tuning a parameter for boosting sounds below the lower cutoff frequency of an electro-dynamic loudspeaker according to an embodiment of the present invention.

Steps 1001, 1002, 1003, 1005, 1007, 1009, 1011, 1013, 1015, 1017, 1019 and 1023 have the same function as that of steps 901, 902, 903, 905, 907, 909, 911, 913, 915, 917, 919 and 923 respectively, and will not be described in detail herein.

At step 1020, it is determined whether there is any parameter values not tested yet. If any, at step 1022, the parameter is set to a parameter value not test yet, and method 1000 returns to step 1013 to estimate a nonlinear distortion value in case of enabling the boosting. If no, method 1000 proceeds to step 1021. Because different settings of parameter values have no effect on the estimation of the nonlinear distortion value in case of disabling the boosting, the nonlinear distortion value estimated at step 1009 may be used as the nonlinear distortion value in case of disabling the boosting at steps 1019 for different settings of parameter values.

At step 1021, with respect to the differences lower than the threshold and corresponding to the different parameter value settings and the same test signal, one of the parameter values corresponding to the differences is accepted. Preferably, it is possible to accept the one that increases the boosting to the largest extent.

In a further embodiment of method 900, it is possible to perform steps 903 to 917 more than one times with test signals which are different only in the phase of at least one of the tone signals, so as to estimate more than one nonlinear distortion values based on the same parameter value setting and the different test signals. Steps 909 and 917 may further comprise averaging the nonlinear distortion values. The averaged result can be used as the nonlinear distortion values in step 919.

In a further embodiment of method 1000, it is possible to perform steps 1003 to 1009 more than one times with test signals which are different only in the phase of at least one of the tone signals, so as to estimate more than one nonlinear distortion values based on the same parameter value setting and the different test signals. Step 1009 may further comprise averaging the nonlinear distortion values. The averaged result can be used as the nonlinear distortion value in case of disabling the boosting in step 1019. A step of generating a test signal may also be added between step 1011 and step 1013. It is possible to perform the step of generating, steps 1013, 1015 and 1017 more than one times with test signals which are different only in the phase of at least one of the tone signals, so as to estimate more than one nonlinear distortion values based on the same parameter value setting and the different test signals. Step 1017 may further comprise averaging the nonlinear distortion values. The averaged result can be used as the nonlinear distortion value in case of enabling the boosting in step 1019.

Figure 11:
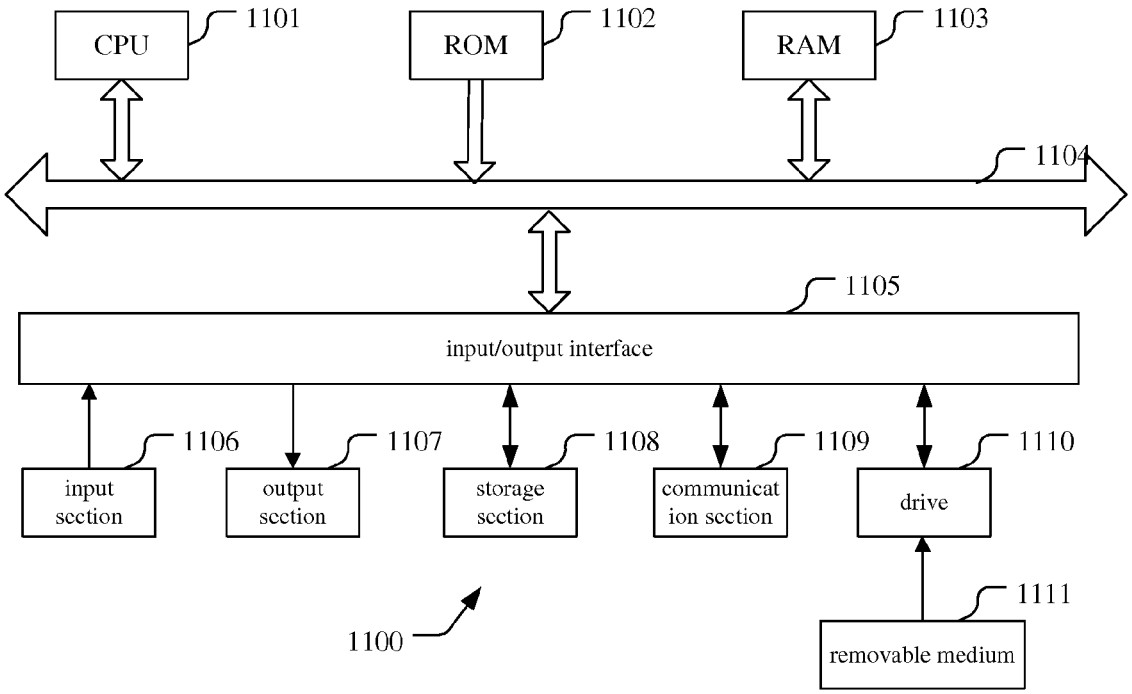
FIG. 11 is a block diagram illustrating an exemplary system for implementing embodiments of the present invention.

FIG. 11 is a block diagram illustrating an exemplary system for implementing the aspects of the present invention.

In FIG. 11, a central processing unit (CPU) 1101 performs various processes in accordance with a program stored in a read only memory (ROM) 1102 or a program loaded from a storage section 1108 to a random access memory (RAM) 1103. In the RAM 1103, data required when the CPU 1101 performs the various processes or the like is also stored as required.

The CPU 1101, the ROM 1102 and the RAM 1103 are connected to one another via a bus 1104. An input/output interface 1105 is also connected to the bus 1104.

The following components are connected to the input/output interface 1105: an input section 1106 including a keyboard, a mouse, or the like; an output section 1107 including a display such as a cathode ray tube (CRT), a liquid crystal display (LCD), or the like, and a loudspeaker or the like; the storage section 1108 including a hard disk or the like; and a communication section 1109 including a network interface card such as a LAN card, a modem, or the like. The communication section 1109 performs a communication process via the network such as the internet.

A drive 1110 is also connected to the input/output interface 1105 as required. A removable medium 1111, such as a magnetic disk, an optical disk, a magneto-optical disk, a semiconductor memory, or the like, is mounted on the drive 1110 as required, so that a computer program read therefrom is installed into the storage section 1108 as required.

In the case where the above-described steps and processes are implemented by the software, the program that constitutes the software is installed from the network such as the internet or the storage medium such as the removable medium 1111.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The following exemplary embodiments (each an "EE") are described.

EE 1. A method of estimating nonlinear distortion of a loudspeaker, comprising:

generating a test signal including at least two simultaneous audible tone signals, wherein one of the tone signals is a fundamental tone signal and each of the rest of the tone signals is a harmonic of the fundamental tone signal, and wherein among harmonic distortion products and intermodulation distortion products of the tone signals within a specified audible frequency range and below a predetermined order of nonlinearity, a separation ratio which is defined as a ratio of the number of the products not at the frequencies of the tone signals to the number of all the products is greater than 0.8;

performing a spectral analysis on the response of the loudspeaker to the test signal; and estimating a nonlinear distortion value by regarding the energy at harmonic frequencies of the fundamental tone signal but not at the frequencies of the tone signals as contribution from the nonlinear distortion.

EE 2. The method according to EE 1, wherein the predetermined order of nonlinearity is lower than ten.

EE 3. The method according to EE 1, wherein the separation ratio is above 0.85.

EE 4. The method according to EE 1, wherein the number of the tone signals is three.

EE 5. The method according to EE 4, wherein the tone signals have frequencies F1, F2=K×F1, F3=P×F1 respectively, where (K, P)=(5,13), (5,19), (7,23), or (13, 21).

EE 6. The method according to EE 1, wherein each of the tone signals other than the fundamental tone signal is an odd harmonic of the fundamental tone signal.

EE 7. The method according to EE 6, wherein the nonlinear distortion value is estimated as the square root of the ratio of the total energy at harmonic frequencies of the fundamental tone signal but not at the frequencies of the tone signals to the total energy at frequencies of the tone signals.

EE 8. The method according to EE 1, wherein one of the following numbers is zero:

the number of the 3rd-order products at frequencies of the tone signals;

the number of the 3rd-order and 4th-order products at frequencies of the tone signals;

the number of the 3rd-order, 4th-order and 5th-order products at frequencies of the tone signals.

EE 9. The method according to EE 1, wherein the loudspeaker is an electro-dynamic loudspeaker, and the frequency of the fundamental tone signal is below the lower cutoff frequency of the loudspeaker, and the frequency of each of the rest of the tone signals is above the lower cutoff frequency.

EE 10. The method according to EE 1, wherein the amplitude of the test signal is less than or equal to x times the maximal amplitude of audio signals allowed to be fed to the loudspeaker, where x is a number between 0.01 and 0.9.

EE 11. The method according to EE 1 or EE 7, further comprising:

performing the following steps at least one time:

generating another test signal which is different only in the phase of at least one of the tone signals;

performing another spectral analysis on the response of the loudspeaker to the other test signal; and estimating another nonlinear distortion value by regarding the energy at harmonic frequencies of the fundamental tone signal but not at the frequencies of the tone signals as contribution from the nonlinear distortion; and averaging all the estimated nonlinear distortion values.

EE 12. A system for estimating nonlinear distortion of a loudspeaker, comprising:

a signal generator which generates a test signal including at least two simultaneous audible tone signals, wherein one of the tone signals is a fundamental tone signal and each of the rest of the tone signals is a harmonic of the fundamental tone signal, and wherein among harmonic distortion products and intermodulation distortion products of the tone signals within a specified audible frequency range and below a predetermined order of nonlinearity, a separation ratio which is defined as a ratio of the number of the products not at the frequencies of the tone signals to the number of all the products is greater than 0.8;

an analyzer which performs a spectral analysis on the response of the loudspeaker to the test signal; and an estimator which estimates a nonlinear distortion value by regarding the energy at harmonic frequencies of the fundamental tone signal but not at the frequencies of the tone signals as contribution from the nonlinear distortion.

EE 13. The system according to EE 12, wherein the predetermined order of nonlinearity is lower than ten.

EE 14. The system according to EE 12, wherein the separation ratio is above 0.85.

EE 15. The system according to EE 12, wherein the number of the tone signals is three.

EE 16. The system according to EE 15, wherein the tone signals have frequencies F1, F2=K×F1, F3=P×F1 respectively, where (K, P)=(5,13), (5,19), (7,23), or (13, 21).

EE 17. The system according to EE 12, wherein each of the tone signals other than the fundamental tone signal is an odd harmonic of the fundamental tone signal.

EE 18. The system according to EE 17, wherein the nonlinear distortion value is estimated as the square root of the ratio of the total energy at harmonic frequencies of the fundamental tone signal but not at the frequencies of the tone signals to the total energy at frequencies of the tone signals.

EE 19. The system according to EE 12, wherein one of the following numbers is zero:

the number of the 3rd-order products at frequencies of the tone signals;

the number of the 3rd-order and 4th-order products at frequencies of the tone signals;

the number of the 3rd-order, 4th-order and 5th-order products at frequencies of the tone signals.

EE 20. The system according to EE 12, wherein the loudspeaker is an electro-dynamic loudspeaker, and the frequency of the fundamental tone signal is below the lower cutoff frequency of the loudspeaker, and the frequency of each of the rest of the tone signals is above the lower cutoff frequency.

EE 21. The system according to EE 12, wherein the amplitude of the test signal is less than or equal to x times the maximal amplitude of audio signals allowed to be fed to the loudspeaker, where x is a number between 0.01 and 0.9.

EE 22. The system according to EE 12 or EE 18, wherein the signal generator is further configured to generate another test signal which is different only in the phase of at least one of the tone signals, the analyzer is further configured to perform another spectral analysis on the response of the loudspeaker to the other test signal, and the estimator is further configured to estimate another nonlinear distortion value by regarding the energy at harmonic frequencies of the fundamental tone signal but not at the frequencies of the tone signals as contribution from the nonlinear distortion, and average all the estimated nonlinear distortion values.

EE 23. A method of tuning a parameter for boosting sounds below the lower cutoff frequency of an electro-dynamic loudspeaker, comprising:

setting the parameter to a parameter value;

generating a test signal including at least two simultaneous audible tone signals, wherein one of the tone signals is a fundamental tone signal and each of the rest of the tone signals is a harmonic of the fundamental tone signal, and wherein among harmonic distortion products and intermodulation distortion products of the tone signals within a specified audible frequency range and below a predetermined order of nonlinearity, a separation ratio which is defined as a ratio of the number of the products not at the frequencies of the tone signals to the number of all the products is greater than 0.8;

processing the test signal in case of enabling the boosting;

performing spectral analyses on the responses of the loudspeaker to the test signal in case of enabling the boosting and in case of disabling the boosting respectively;

estimating nonlinear distortion values by regarding the energy at harmonic frequencies of the fundamental tone signal but not at the frequencies of the tone signals as contribution from the nonlinear distortion in the two cases respectively;

calculating a difference by subtracting the nonlinear distortion value estimated in case of disabling the boosting from the nonlinear distortion value estimated in case of enabling the boosting based on the setting of the parameter value; and accepting the parameter value if the difference is lower than a threshold.

EE 24. The method according to EE 23, further comprising:

with respect to each of at least one other parameter value different from the parameter value, performing the following steps:

setting the parameter to the each of at least one other parameter value;

processing the test signal in case of enabling the boosting;

performing a spectral analysis on the response of the loudspeaker to the test signal in case of enabling the boosting;

estimating a nonlinear distortion value by regarding the energy at harmonic frequencies of the fundamental tone signal but not at the frequencies of the tone signals as contribution from the nonlinear distortion in case of enabling the boosting; and wherein the calculating comprises calculating a difference by subtracting the nonlinear distortion value estimated in case of disabling the boosting from the nonlinear distortion value estimated in case of enabling the boosting based on the setting of the each of at least one other parameter value, and wherein the accepting comprises:

with respect to the differences lower than the threshold and corresponding to the different parameter value settings and the same test signal, accepting one of the parameter values corresponding to the differences.

EE 25. The method according to EE 24, wherein the one accepted increases the boosting to the largest extent.

EE 26. The method according to EE 23 or EE 24, wherein the predetermined order of nonlinearity is lower than ten.

EE 27. The method according to EE 23 or EE 24, wherein the separation ratio is above 0.85.

EE 28. The method according to EE 23 or EE 24, wherein the number of the tone signals is three.

EE 29. The method according to EE 28, wherein the tone signals have frequencies F1, F2=K×F1, F3=P×F1 respectively, where (K, P)=(5,13), (5,19), (7,23), or (13, 21).

EE 30. The method according to EE 23 or EE 24, wherein each of the tone signals other than the fundamental tone signal is an odd harmonic of the fundamental tone signal.

EE 31. The method according to EE 23 or EE 24, wherein one of the following numbers is zero:

the number of the 3rd-order products at frequencies of the tone signals;

the number of the 3rd-order and 4th-order products at frequencies of the tone signals;

the number of the 3rd-order, 4th-order and 5th-order products at frequencies of the tone signals.

EE 32. The method according to EE 23 or EE 24, wherein the frequency of the fundamental tone signal is below the lower cutoff frequency of the loudspeaker, and the frequency of each of the rest of the tone signals is above the lower cutoff frequency.

EE 33. The method according to EE 23 or EE 24, wherein the amplitude of the test signal is less than or equal to x times the maximal amplitude of audio signals allowed to be fed to the loudspeaker, where x is a number between 0.01 and 0.9.

EE 34. The method according to EE 23 or EE 24, wherein the nonlinear distortion value is estimated as the square root of the ratio of the total energy at harmonic frequencies of the fundamental tone signal but not at the frequencies of the tone signals to the total energy at frequencies of the tone signals.

EE 35. The method according to EE 34, wherein the threshold is equal to or smaller than 0.3.

EE 36. The method according to EE 23 or EE 24, further comprising:

performing the following steps at least one time:

generating another test signal which is different only in the phase of at least one of the tone signals;

processing the other test signal in case of enabling the boosting;

performing other spectral analyses on the responses of the loudspeaker to the other test signal in case of enabling the boosting and in case of disabling the boosting respectively; and estimating other nonlinear distortion values by regarding the energy at harmonic frequencies of the fundamental tone signal but not at the frequencies of the tone signals as contribution from the nonlinear distortion in the two cases respectively, and wherein the calculating comprises:

averaging all the nonlinear distortion values estimated based on the same setting of parameter value and the different test signals in case of enabling the boosting as the nonlinear distortion value estimated in case of enabling the boosting; and averaging all the nonlinear distortion values estimated based on the same setting of parameter value and the different test signals in case of disabling the boosting as the nonlinear distortion estimated in case of disabling the boosting.

EE 37. The method according to EE 23 or EE 24, wherein the parameter is the maximal output level of a limiter.

EE 38. A system for tuning a parameter for boosting sounds below the lower cutoff frequency of an electro-dynamic loudspeaker, comprising:

a controller which sets the parameter to a parameter value;

a signal generator which generates a test signal including at least two simultaneous audible tone signals, wherein one of the tone signals is a fundamental tone signal and each of the rest of the tone signals is a harmonic of the fundamental tone signal, and wherein among harmonic distortion products and intermodulation distortion products of the tone signals within a specified audible frequency range and below a predetermined order of nonlinearity, a separation ratio which is defined as a ratio of the number of the products not at the frequencies of the tone signals to the number of all the products is greater than 0.8;

a bass enhancer which processes the test signal in case of enabling the boosting and does not process the test signal in case of disabling the boosting;

an analyzer which performs spectral analyses on the responses of the loudspeaker to the test signal in the two cases respectively;

an estimator which estimates nonlinear distortion values by regarding the energy at harmonic frequencies of the fundamental tone signal but not at the frequencies of the tone signals as contribution from the nonlinear distortion in the two cases respectively;

a calculator which calculates a difference by subtracting the nonlinear distortion value estimated in case of disabling the boosting from the nonlinear distortion value estimated in case of enabling the boosting based on the setting of the parameter value; and a judger which accepts the parameter value if the difference is lower than a threshold.

EE 39. The system according to EE 38, wherein the controller is further configured to set the parameter to each of at least one other parameter value, the bass enhancer is further configured to process the test signal in case of enabling the boosting in response to the setting of the each of at least one other parameter value and not to process the test signal in case of disabling the boosting;

the analyzer is further configured to perform a spectral analysis on the response of the loudspeaker to the test signal in case of enabling the boosting in response to the setting of the each of at least one other parameter value;

the estimator is further configured to estimate a nonlinear distortion value in case of enabling the boosting by regarding the energy at harmonic frequencies of the fundamental tone signal but not at the frequencies of the tone signals as contribution from the nonlinear distortion in response to the setting of the each of at least one other parameter value;

wherein the calculator is further configured to calculate a difference by subtracting the nonlinear distortion value estimated in case of disabling the boosting from the nonlinear distortion value estimated in case of enabling the boosting based on the setting of the each of at least one other parameter value, and wherein the judger is further configured to, with respect to the differences lower than the threshold and their corresponding parameter values, accept one of the corresponding parameter values.

EE 40. The system according to EE 39, wherein the one accepted increases the boosting to the largest extent.

EE 41. The system according to EE 38 or EE 39, wherein the predetermined order of nonlinearity is lower than ten.

EE 42. The system according to EE 38 or EE 39, wherein the separation ratio is above 0.85.

EE 43. The system according to EE 38 or EE 39, wherein the number of the tone signals is three.

EE 44. The system according to EE 43, wherein the tone signals have frequencies F1, F2=K×F1, F3=P×F1 respectively, where (K, P)=(5,13), (5,19), (7,23), or (13, 21).

EE 45. The system according to EE 38 or EE 39, wherein each of the tone signals other than the fundamental tone signal is an odd harmonic of the fundamental tone signal.

EE 46. The system according to EE 38 or EE 39, wherein one of the following numbers is zero:

the number of the 3rd-order products at frequencies of the tone signals;

the number of the 3rd-order and 4th-order products at frequencies of the tone signals;

the number of the 3rd-order, 4th-order and 5th-order products at frequencies of the tone signals.

EE 47. The system according to EE 38 or EE 39, wherein the frequency of the fundamental tone signal is below the lower cutoff frequency of the loudspeaker, and the frequency of each of the rest of the tone signals is above the lower cutoff frequency.

EE 48. The system according to EE 38 or EE 39, wherein the amplitude of the test signal is less than or equal to x times the maximal amplitude of audio signals allowed to be fed to the loudspeaker, where x is a number between 0.01 and 0.9.

EE 49. The system according to EE 38 or EE 39, wherein the nonlinear distortion value is estimated as the square root of the ratio of the total energy at harmonic frequencies of the fundamental tone signal but not at the frequencies of the tone signals to the total energy at frequencies of the tone signals.

EE 50. The system according to EE 49, wherein the threshold is equal to or smaller than 0.3.

EE 51. The system according to EE 38 or EE 39, wherein the signal generator is further configured to generate another test signal which is different only in the phase of at least one of the tone signals;

the bass enhancer is further configured to process the other test signal in case of enabling the boosting and not to process the other test signal in case of disabling the boosting;

the analyzer is further configured to perform other spectral analyses on the responses of the loudspeaker to the other test signal in the two cases respectively;

the estimator is further configured to estimate other nonlinear distortion values by regarding the energy at harmonic frequencies of the fundamental tone signal but not at the frequencies of the tone signals as contribution from the nonlinear distortion in the two cases respectively, and the calculator is further configured to:

average all the nonlinear distortion values estimated based on the same setting of parameter value and the different test signals in case of enabling the boosting as the nonlinear distortion value estimated in case of enabling the boosting; and average all the nonlinear distortion values estimated based on the same setting of parameter value and the different test signals in case of disabling the boosting as the nonlinear distortion estimated in case of disabling the boosting.

EE 52. The system according to EE 38 or EE 39, wherein the parameter is the maximal output level of a limiter.

EE 53. A computer-readable medium having computer program instructions recorded thereon for enabling a processor to perform a method of estimating nonlinear distortion of a loudspeaker comprising:

generating a test signal including at least two simultaneous audible tone signals, wherein one of the tone signals is a fundamental tone signal and each of the rest of the tone signals is a harmonic of the fundamental tone signal, and wherein among harmonic distortion products and intermodulation distortion products of the tone signals within a specified audible frequency range and below a predetermined order of nonlinearity, a separation ratio which is defined as a ratio of the number of the products not at the frequencies of the tone signals to the number of all the products is greater than 0.8;

performing a spectral analysis on the response of the loudspeaker to the test signal; and estimating a nonlinear distortion value by regarding the energy at harmonic frequencies of the fundamental tone signal but not at the frequencies of the tone signals as contribution from the nonlinear distortion.

EE 54. A computer-readable medium having computer program instructions recorded thereon for enabling a processor to perform a method of tuning a parameter for boosting sounds below the lower cutoff frequency of an electro-dynamic loudspeaker comprising:

setting the parameter to a parameter value;

generating a test signal including at least two simultaneous audible tone signals, wherein one of the tone signals is a fundamental tone signal and each of the rest of the tone signals is a harmonic of the fundamental tone signal, and wherein among harmonic distortion products and intermodulation distortion products of the tone signals within a specified audible frequency range and below a predetermined order of nonlinearity, a separation ratio which is defined as a ratio of the number of the products not at the frequencies of the tone signals to the number of all the products is greater than 0.8;

processing the test signal in case of enabling the boosting;

performing spectral analyses on the responses of the loudspeaker to the test signal in case of enabling the boosting and in case of disabling the boosting respectively;

estimating nonlinear distortion values by regarding the energy at harmonic frequencies of the fundamental tone signal but not at the frequencies of the tone signals as contribution from the nonlinear distortion in the two cases respectively;

calculating a difference by subtracting the nonlinear distortion value estimated in case of disabling the boosting from the nonlinear distortion value estimated in case of enabling the boosting based on the setting of the parameter value; and accepting the parameter value if the difference is lower than a threshold.

I claim:

1. A method of estimating nonlinear distortion of a loudspeaker, comprising:

generating a test signal including at least two simultaneous audible tone signals and applying the generated signal to the loudspeaker, wherein one of the tone signals is a fundamental tone signal and each of the rest of the tone signals is a harmonic of the fundamental tone signal, and wherein among harmonic distortion products and intermodulation distortion products of the tone signals within a specified audible frequency range and below a predetermined order of nonlinearity, a ratio of the number of the products not at the frequencies of the tone signals to the number of all the products is greater than 0.8;

performing a spectral analysis on the response of the loudspeaker to the test signal; and estimating a nonlinear distortion value by regarding energy at harmonic frequencies of the fundamental tone signal but not at the frequencies of the tone signals as contribution from the nonlinear distortion, wherein the method is applied to enhance performance of the loudspeaker.

2. The method according to claim 1, wherein the predetermined order of nonlinearity is lower than ten.

3. The method according to claim 1, wherein each of the tone signals other than the fundamental tone signal is an odd harmonic of the fundamental tone signal.

4. The method according to claim 3, wherein the nonlinear distortion value is estimated as the square root of the ratio of the total energy at harmonic frequencies of the fundamental tone signal but not at the frequencies of the tone signals to the total energy at frequencies of the tone signals.

5. The method according to claim 1, wherein one of the following numbers is zero:

the number of the 3rd-order products at frequencies of the tone signals;

the number of the 3rd-order and 4th-order products at frequencies of the tone signals;

the number of the 3rd-order, 4th-order and 5th-order products at frequencies of the tone signals.

6. The method according to claim 1, wherein the loudspeaker is an electro-dynamic loudspeaker, and the frequency of the fundamental tone signal is below the lower cutoff frequency of the loudspeaker, and the frequency of each of the rest of the tone signals is above the lower cutoff frequency.

7. The method according to claim 1, wherein the amplitude of the test signal is less than or equal to x times the maximal amplitude of audio signals allowed to be fed to the loudspeaker, where x is a number between 0.01 and 0.9.

8. The method according to claim 1, further comprising:

performing the following steps at least one time:

generating another test signal which is different only in the phase of at least one of the tone signals;

performing another spectral analysis on the response of the loudspeaker to the other test signal; and estimating another nonlinear distortion value by regarding the energy at harmonic frequencies of the fundamental tone signal but not at the frequencies of the tone signals as contribution from the nonlinear distortion; and averaging all the estimated nonlinear distortion values.

9. A system for estimating nonlinear distortion of a loudspeaker, comprising:

a signal generator which generates a test signal including at least two simultaneous audible tone signals and applying the generated signal to the loudspeaker, wherein one of the tone signals is a fundamental tone signal and each of the rest of the tone signals is a harmonic of the fundamental tone signal, and wherein among harmonic distortion products and intermodulation distortion products of the tone signals within a specified audible frequency range and below a predetermined order of nonlinearity, a ratio of the number of the products not at the frequencies of the tone signals to the number of all the products is greater than 0.8;

an analyzer which performs a spectral analysis on the response of the loudspeaker to the test signal; and an estimator which estimates a nonlinear distortion value by regarding the energy at harmonic frequencies of the fundamental tone signal but not at the frequencies of the tone signals as contribution from the nonlinear distortion, wherein the method is applied to enhance performance of the loudspeaker.

10. The system according to claim 9, wherein the predetermined order of nonlinearity is lower than ten.

11. The system according to claim 9, wherein each of the tone signals other than the fundamental tone signal is an odd harmonic of the fundamental tone signal.

12. The system according to claim 11, wherein the nonlinear distortion value is estimated as the square root of the ratio of the total energy at harmonic frequencies of the fundamental tone signal but not at the frequencies of the tone signals to the total energy at frequencies of the tone signals.

13. The system according to claim 9, wherein one of the following numbers is zero:

the number of the 3rd-order products at frequencies of the tone signals;

the number of the 3rd-order and 4th-order products at frequencies of the tone signals;

the number of the 3rd-order, 4th-order and 5th-order products at frequencies of the tone signals.

14. The system according to claim 9, wherein the loudspeaker is an electro-dynamic loudspeaker, and the frequency of the fundamental tone signal is below the lower cutoff frequency of the loudspeaker, and the frequency of each of the rest of the tone signals is above the lower cutoff frequency.

15. The system according to claim 9, wherein the signal generator is further configured to generate another test signal which is different only in the phase of at least one of the tone signals, the analyzer is further configured to perform another spectral analysis on the response of the loudspeaker to the other test signal, and the estimator is further configured to estimate another nonlinear distortion value by regarding the energy at harmonic frequencies of the fundamental tone signal but not at the frequencies of the tone signals as contribution from the nonlinear distortion, and average all the estimated nonlinear distortion values.

16. A method of tuning a parameter for boosting sounds below the lower cutoff frequency of an electro-dynamic loudspeaker, comprising:

setting the parameter to a parameter value;

generating a test signal including at least two simultaneous audible tone signals, wherein one of the tone signals is a fundamental tone signal and each of the rest of the tone signals is a harmonic of the fundamental tone signal, and wherein among harmonic distortion products and intermodulation distortion products of the tone signals within a specified audible frequency range and below a predetermined order of nonlinearity, a ratio of the number of the products not at the frequencies of the tone signals to the number of all the products is greater than 0.8;

processing the test signal in case of enabling the boosting;

performing spectral analyses on the responses of the loudspeaker to the test signal in case of enabling the boosting and in case of disabling the boosting respectively;

estimating nonlinear distortion values by regarding the energy at harmonic frequencies of the fundamental tone signal but not at the frequencies of the tone signals as contribution from the nonlinear distortion in the two cases respectively;

calculating a difference by subtracting the nonlinear distortion value estimated in case of disabling the boosting from the nonlinear distortion value estimated in case of enabling the boosting based on the setting of the parameter value; and accepting the parameter value if the difference is lower than a threshold, wherein the method of tuning the parameters enhance loudspeaker operations.

17. The method according to claim 16, wherein each of the tone signals other than the fundamental tone signal is an odd harmonic of the fundamental tone signal.

18. The method according to claim 16, wherein one of the following numbers is zero:

the number of the 3rd-order products at frequencies of the tone signals;

the number of the 3rd-order and 4th-order products at frequencies of the tone signals;

the number of the 3rd-order, 4th-order and 5th-order products at frequencies of the tone signals.

19. The method according to claim 16, wherein the frequency of the fundamental tone signal is below the lower cutoff frequency of the loudspeaker, and the frequency of each of the rest of the tone signals is above the lower cutoff frequency.

* * * * *